US006900006B2

(12) United States Patent
Gibson et al.

(10) Patent No.: US 6,900,006 B2
(45) **Date of Patent: *May 31, 2005**

(54) PHOTOGRAPHIC ELEMENTS CONTAINING A DE-AGGREGATING COMPOUND, DYE-FORMING COUPLER AND STABILIZER

(75) Inventors: Danuta Gibson, Watford (GB); David Clarke, Watford (GB); Christopher J. Winscom, Pinner (GB); Michael W. Crawley, Watford (GB)

(73) Assignee: Eastman Kodak Company, Rochester, NY (US)

( * ) Notice: Subject to any disclaimer, the term of this patent is extended or adjusted under 35 U.S.C. 154(b) by 230 days.

This patent is subject to a terminal disclaimer.

(21) Appl. No.: 10/309,592

(22) Filed: Dec. 4, 2002

(65) Prior Publication Data

US 2003/0186178 A1 Oct. 2, 2003

(30) Foreign Application Priority Data

Dec. 20, 2001 (GB) ..... 0130416

(51) Int. Cl.[7] ..... G03C 1/08; G03C 7/26; G03C 7/32

(52) U.S. Cl. ..... 430/558; 430/546; 430/551; 430/512; 430/931; 430/384; 430/385

(58) Field of Search ..... 430/543, 546, 430/551, 558, 512, 931, 384, 385

(56) References Cited

U.S. PATENT DOCUMENTS

| | | | | |
|---|---|---|---|---|
| 3,843,371 A | | 10/1974 | Piller et al. | |
| 3,845,049 A | | 10/1974 | Piller et al. | |
| 5,294,528 A | | 3/1994 | Furutachi | |
| 5,300,414 A | | 4/1994 | Leppard et al. | |
| 5,364,749 A | | 11/1994 | Leppard et al. | |
| 5,541,045 A | | 7/1996 | Takahashi et al. | |
| 5,686,233 A | * | 11/1997 | Valet et al. | 430/512 |
| 6,007,975 A | | 12/1999 | Tomotake et al. | |
| 6,242,169 B1 | | 6/2001 | Hagemann et al. | |

FOREIGN PATENT DOCUMENTS

| | | |
|---|---|---|
| DE | 2113833 | 3/1971 |
| DE | 44 44 258 | 11/1995 |
| EP | 0 886 179 | 10/2001 |
| GB | 2 319 523 | 5/1998 |

OTHER PUBLICATIONS

D. Gibson et al, "Photographic Elements Containing a De–Aggregating Compound and Dye–Forming Coupler", U.S. Appl. No. 10/309,474, (D–83160) filed Dec. 4, 2002.

* cited by examiner

*Primary Examiner*—Geraldine Letscher
(74) *Attorney, Agent, or Firm*—Arthur E. Kluegel

(57) ABSTRACT

The invention relates to a photographic element comprising at least one light-sensitive silver halide emulsion layer having associated therewith in the same dispersion a certain de-aggregating compound at least one heterocyclic cyan dye-forming coupler of a specified formula and an aromatic stabilizer of a particular formula. The combination provides improved image stability.

33 Claims, 1 Drawing Sheet

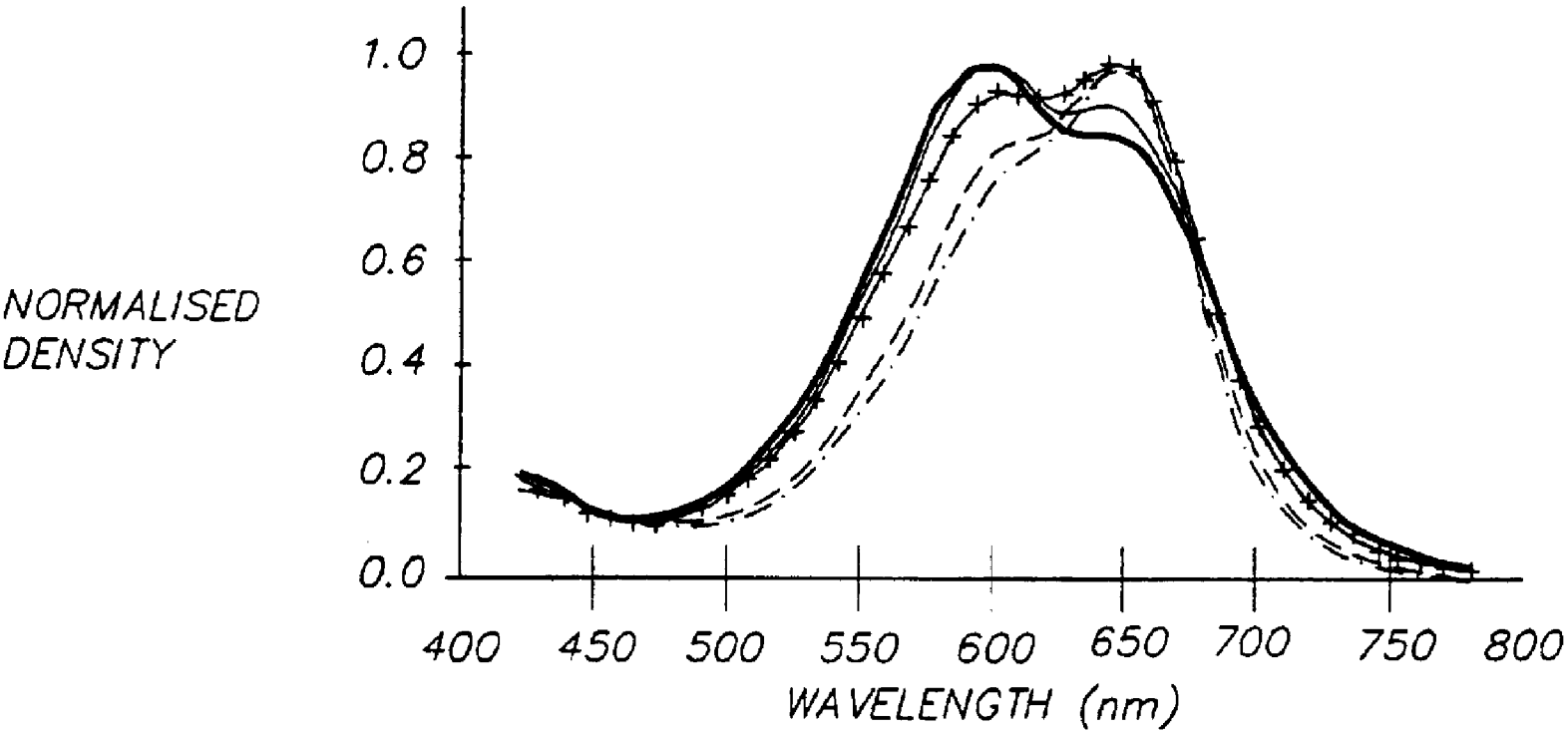
NORMALISED DENSITY
1.0
0.8
0.6
0.4
0.2
0.0
400
450
500
550
600
650
700
750
800
WAVELENGTH (nm)

PHOTOGRAPHIC ELEMENTS CONTAINING A DE-AGGREGATING COMPOUND, DYE-FORMING COUPLER AND STABILIZER

CROSS REFERENCE TO RELATED APPLICATIONS

This application is related to co-filed and commonly assigned U.S. Ser. No. 10/309,974 by Gibson, et al (D-83160).

FIELD OF THE INVENTION

This invention relates to a silver halide colour photographic material, and more particularly to a silver halide colour photographic material with improved light stability, colour reproducibility and improved dye hue.

BACKGROUND OF THE INVENTION

In any chromogenic photographic material it is desirable that the dyes formed should be bright in colour, absorbing light in the appropriate spectral region, with very little secondary absorption so that good colour reproducibility is obtained. It is also important that the formed photographic images should be resistant to fading due to heat, humidity and light. Many of the desired hue characteristics are achieved by changing the molecular structure of the photographic dye-forming coupler, hereinafter coupler. For example alkyl substituents on a pyrazolotriazole nucleus will form magenta dyes on photographic development, whereas carbonamido-substituted pyrazolotriazoles form cyan dyes. In addition, adjusting the environment of the coupler can influence the dye hue of the azomethine dye that is formed during photographic processing. For example, the spectral properties of the dyes can be altered using hue-shifting solvents such as sulfonamides (EP-A-0 309 159, EP-A-0 264 083), carbonamides (e.g. U.S. Pat. Nos. 4,935,321 and 5,258,278), aryl ureas (U.S. Pat. No. 4,808,502), ballasted and substituted phenols (U.S. Pat. No. 4,562,146, DE 3,936,300), sulfones and sulfoxides (U.S. Pat. No. 5,232,821) and phosphate esters (EP-A-0 515 128).

For economic and environmental reasons, a reduction in the quantities of materials used in photographic materials is desirable. Couplers derived from bicyclic or even tricyclic heterocyclic compounds are increasingly being utilised because they can form dyes with higher absorptivities than those that have been used for many years (such as phenolic and naphtholic cyan couplers). Thus, on an equimolar basis, these heterocyclic couplers can provide much higher dye densities from the same amounts of silver, so that it is possible to generate the same dye densities from lower laydowns of silver and coupler.

Whilst pyrazolo-based couplers have been used in photographic products for magenta dyes, their use in the formation of cyan dyes is more problematical. Several patents exist which refer to this class of cyan couplers and most of them address the two problems associated with them: they form dyes which are highly aggregated, that is they form a self-associating assembly of monomeric molecules, and the light stability of these dyes is very poor.

Dye aggregation is a major concern for these couplers because, although the desired spectral absorptions of these dyes are due to the monomeric species, the unwanted secondary absorptions are caused by the presence of aggregated dye. These secondary absorptions have a deleterious effect on the quality of the image that is produced so that the hues of a scene are rendered much less accurately than required. Hue-shifting by solvents alone is of little use and a de-aggregating compound is also required.

U.S. Pat. No. 5,294,528 lists a variety of agents that can be used to break the aggregation of an azomethine dye (more correctly an azamethine dye), in particular the dye from a magenta class of pyrazolotriazole couplers. It is claimed in this patent that "azomethine dyes formed from pyrazoloazole couplers are liable to aggregate, and the higher the aggregation degree of the dyes is, the lower the light-fastness is, and that by breaking the aggregation the light-fastness of azomethine dyes can be enhanced". Whilst it is true that some magenta pyrazoloazole couplers with bulky substituents provide dyes which are less aggregated and have better light stability than those with less bulky substituents, de-aggregation is not the main cause of improved light stability. A de-aggregating compound is understood to act by intervention within the dispersed oil phase containing the aggregated dye, and is necessarily a component of the coupler dispersion. Compounds which de-aggregate in this way may perform quite different functions if included in separate dispersions, e.g. as UV absorbers. Furthermore, compounds which act as stabilizers may benefit in a synergistic, rather than a simple additive, way when included in the same dispersion as the coupler and de-aggregating agent. We have found that de-aggregating compounds do not necessarily provide extra light stability unless another appropriate light stabilizer is present. Thus improved light stability is not correlated with de-aggregation.

EP-A-0 886 179 suggests that liquid crystalline solvents can be used to improve colour reproducibility for a variety of heterocyclic coupler classes, including pyrazolo-based couplers. EP-A-0 883 024 and U.S. Pat. No. 6,132,945 indicate that cyclic imide materials and phenyl carboxylic acid derivatives improve the colour reproduction of azomethine dyes produced by pyrrolotriazole couplers. U.S. Pat. No. 6,007,975 suggests that a phenolic coupler can be combined with various heterocyclic cyan couplers to improve colour reproduction.

All of these have been investigated and have problems with them, not least that, whilst dye aggregation can be reduced, light stability has not been improved sufficiently to become practicable. The reason for this is that pyrazolo-based couplers which form cyan dyes on photographic development differ from magenta ones in that they have electron-withdrawing functionalities attached to the heterocyclic nucleus. This appears to make them less amenable to dye stabilization via the methods used for their magenta counterparts. These methods to improve dye stability involve using compounds such as, for example, spiroindanes (U.S. Pat. No. 5,212,055), bisphenols (U.S. Pat. No. 3,700,455), thiomorpholine dioxide materials (U.S. Pat. Nos. 5,491,054 and 5,484,696), metal complexes (DE 3605279) or combinations of these including antioxidants (EP-A-0 203 746). All of these, even when including the use of high levels of solvent to help de-aggregate the dye, contribute to very small improvements in dye stability, with often little or no improvement in colour quality.

Another way of improving dye stability is to utilise UV absorbers, usually in a separate UV filtration layer, although it is sometimes beneficial to combine the UV absorbers in the same layer as the coupler.

One group of UV absorbers usually used in a separate layer are the 2-hydroxyphenyltriazines as described in DE 2113833 and DE 2230304. 2-hydroxyphenyltriazine materials in conjunction with magenta or yellow couplers to improve dye stability and $D_{min}$ yellowing have been disclosed in DE 4444258 and U.S. Pat. No. 5,541,045 respectively. DE 19538950 and DE 19701869 describe their use with phenolic and heterocyclic cyan couplers (although not pyrazolotriazole couplers, whose dominant mechanism of light-fade can be shown to be quite different), for dye stability improvements. DE 19701719 teaches that distinct dispersions of stabilizer and coupler in the same layer can provide improved dark storage and light stability of the cyan image but additional dye hue improvements via de-aggregation of the dye are never mentioned.

U.S. Pat. No. 6,242,169 discloses a colour photographic material containing a pyrazoloazole cyan coupler and a phenolic solvent, substituted in the para position with a nitrogen- or sulfur-bound group, the material having improved light stability. Although a phenoxy stabilizer may optionally be present, preferably in the same layer, there is no working example of its inclusion, no teaching that it would be in the same dispersion as the coupler, nor that hydroxy substitution would be favoured over, for example, alkoxy substitution.

PROBLEM TO BE SOLVED BY THE INVENTION

The dyes formed from heterocyclic couplers based on a pyrazole ring structure, such as pyrazolotriazoles and pyrazolobenzimidazoles, are highly aggregated. The main spectral absorptions of these dyes are due to the monomeric species, but the secondary absorptions caused by the presence of aggregated dye have a deleterious effect on the quality of the image produced, so that the colours of a scene are represented less accurately than desired. Hue-shifting by solvents alone is of little use, so that a compound that will de-aggregate the dyes formed is also required. Such de-aggregating compounds which can provide photographic materials with an increased colour gamut, do not necessarily, however, provide sufficient stability of the cyan image. There is therefore a need to find a combination of compounds which maintains de-aggregation and additionally provides such stabilization.

SUMMARY OF THE INVENTION

It has now been found that, when a heterocyclic compound including at least one group that can provide intramolecular hydrogen-bonding and which is partially or wholly conjugated with the heterocyclic ring system, such as, for example, a 2-hydroxyphenyltriazine compound, is combined in the same dispersion with, for example, a cyan pyrazolotriazole or pyrazolo-benzimidazole coupler, and a certain type of dye stabilizer in a photographic element, there is unexpectedly de-aggregation of the dyes formed. Thus there is reduction in the unwanted green absorptions in the spectra of the azomethine dyes and improvement in colour reproduction, surprisingly coupled with an outstanding improvement in light stability.

Thus according to the present invention there is provided a photographic element comprising at least one light-sensitive silver halide emulsion layer having associated therewith in the same dispersion a de-aggregating compound of formula (I), at least one heterocyclic cyan dye-forming coupler of formula (II) and a stabilizer of formula (III):

wherein the de-aggregating compound has the formula (I)

(I)

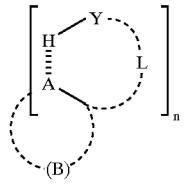

wherein

A is a hydrogen-bond-accepting hetero-atom or -group;

Y is a hydrogen-bond-donating hetero-atom or -group;

L is a linking group that is partially or wholly conjugated with A and linked to A by a carbon atom;

n is 1, 2 or 3 hydrogen-bond-containing moieties; and (B) comprises the remaining atoms for completion of an unsubstituted or substituted heterocyclic ring or ring system containing the hydrogen bond-accepting hetero-atom or -group, which may contain one or more other heteroatoms selected from nitrogen, oxygen and sulfur; and wherein the heterocyclic cyan dye-forming coupler has the formula (II):

(II)

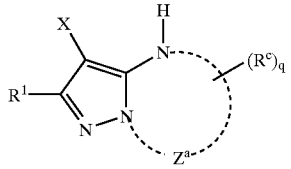

wherein $R^1$ is hydrogen or a substituent;

$R^c$ is a substituent; and q is 0 to 4;

$Z^a$ represents the atoms necessary to complete an unsubstituted or substituted 5- to 10-membered heterocyclic ring system which may contain one or more other heteroatoms selected from nitrogen, oxygen and sulfur;

providing that each $R^c$ is attached to a carbon atom of the ring; and

X is selected from hydrogen or halogen or a group which is separable by the reaction of coupler with an oxidized colour developing agent; and wherein the stabilizer of formula (III) has the formula (III)

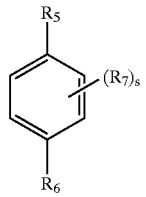

wherein $R_5$ is an electron-donating group;

$R_6$ is a substituent;

each $R_7$ is an independently selected substituent; or one of $R_5$ and $R_6$ may join with $R_7$ to form an unsubstituted or substituted 5- to 10-membered ring system which may contain one or more heteroatoms selected from nitrogen, oxygen and sulfur; and s is 0 to 4;

provided that (a) when one of $R_5$ and $R_6$ is a hydroxy group then the other may not be an arylsulfonamido or arylsulfamoyl substituent, and (b) at least one of $R_5$, $R_6$ and $R_7$ contains a ballast group comprising at least 8 carbon atoms.

In another embodiment of the invention there is provided a multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element is as herein described.

In yet another embodiment of the invention there is provided a process of forming an image in a photographic element as hereinbefore defined after the element has been imagewise exposed to light, comprising contacting the element, as herein described, with a colour developing agent.

ADVANTAGEOUS EFFECT OF THE INVENTION

This invention allows for an improvement in the colour quality and stability of photographic materials which have in, at least one layer, a bicyclic or tricyclic coupler incorporating a pyrazole moiety as one of the heterocyclic rings. Not only are the spectral bandwidths narrowed significantly by the use of de-aggregating heterocyclic compounds, thus reducing unwanted absorptions, but also an enhanced image stabilization is obtained by the use of a specified stabilizer compared with that that can be achieved in the absence of the de-aggregating compound.

BRIEF DESCRIPTION OF THE DRAWINGS

The FIGURE shows the spectra obtained from the dyes generated in exposed and processed monochrome coatings of cyan coupler C-8 in solvent D with (or without) certain addenda.

The thick solid line represents the spectrum from the coupler in solvent alone, i.e. with no additional addenda, which displays a main absorption band due to aggregated dye.

The thin solid line represents the spectrum from the coupler with a stabilizer ST-4 of formula (III).

The thin solid line with + signs represents the spectrum from the coupler with stabilizer ST-1 of formula (III).

The thin dashed line represents the spectrum from the coupler with a stabilizer ST-4 of formula (III) and compound I-1 of formula (I)

The thin dashed-dotted line represents the spectrum from the coupler with stabilizer ST-1 of formula (III) and compound I-1 of formula (I).

DETAILED DESCRIPTION OF THE INVENTION

The invention is described as in the Summary of the Invention and relates to the de-aggregation of dyes derived from certain heterocyclic couplers to provide a more accurate rendition of hues in photographic materials and enhanced image stabilization.

As used herein and throughout the specification unless where specifically stated otherwise, the term "alkyl" refers to a saturated or unsaturated, straight or branched chain alkyl group including alkenyl and aralkyl, and includes cyclic groups, including cycloalkenyl, having 3–8 carbon atoms. The term "aryl" includes fused aryl. As used herein and throughout the specification the term "conjugated" means the linking together of centres of unsaturation.

In the compounds of formula (I), A is a hydrogen-bond-accepting hetero-atom or -group, such as a carbonyl, iminyl, sulfonyl, sulfinyl group or more preferably a nitrogen atom.

(B) comprises the remaining atoms for completion of an unsubstituted or substituted heterocyclic ring, which is preferably a triazine, pyrimidine or pyridine, but which may also be, for example, a triazole or diazepine or a heterocyclic ring system such as a [5,5], [5,6] or [6,6] ring system, for example, a pyrazoloazole, azaindole or 1,8-diazanaphthalene ring system.

L is a linking group that is partially or wholly conjugated with A and linked to A by a carbon atom and may, for example, include a sulfonyl, sulfinyl or carbonyl group. As used herein, the term conjugated refers to a system where a sequence of three or more atoms exhibits delocalized bonding over three or more atoms. It is wholly conjugated if A of Formula (I) is directly conjugated through L with Y. It is partially conjugated (or "cross-conjugated") if both A and Y are individually conjugated to a third intermediate atom or group that forms part of L but are not themselves directly conjugated with each other. See ADVANCED ORGANIC CHEMISTRY: REACTION MECHANISMS AND STRUCTURE, Wiley Interscience, NY, N.Y. (1992) pg 33. More especially the linking group comprises one or more alkenyl groups which can complete an unsubstituted or substituted 5- to 10-membered ring system, which may contain one or more other heteroatoms selected from nitrogen, oxygen and sulfur, such as a phenyl, naphthyl, quinolinyl, pyridyl or benzimidazolyl ring system.

Y is an atom or group that can provide intramolecular hydrogen-bonding with A and is selected, for example, from —O—, —NR, —NCOR, —NCONHR or —$NSO_2R$, wherein R is an unsubstituted or substituted alkyl or aryl group, or —N—, wherein the nitrogen atom forms with L part of a 5- to 10-membered heterocyclic ring system, for example a benzimidazole ring or a 2- or 4-pyridone ring.

In a preferred embodiment the de-aggregating compound has the formula (IA), (IA)

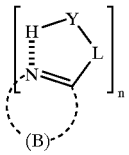

wherein

—N is an aza nitrogen atom;

L is selected from the class consisting of a sulfonyl, sulfinyl and carbonyl group and one or more alkenyl groups which form part of an unsubstituted or substituted 5- to 10-membered ring system, which may contain one or more other heteroatoms selected from nitrogen, oxygen and sulfur;

(B) comprises the remaining atoms for completion of an unsubstituted or substituted 5- to 10-membered heterocyclic ring or ring system containing the hydrogen bond-accepting hetero-atom or -group, which may contain one or more other heteroatoms selected from nitrogen, oxygen and sulfur; and Y and n are as defined for formula (I).

Preferably (B) with N═ completes the atoms of a 5-, 6- or 7-membered heterocyclic ring, more preferably a 6-membered ring.

More preferably the de-aggregating compound has the formula (IB)

(IB)

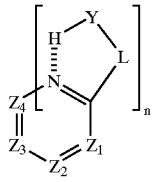

wherein $Z_1$ to $Z_4$ are independently nitrogen atoms or unsubstituted or substituted carbon atoms, one or two adjacent pairs of which may each support an additional hydrogen-bond-containing moiety, each moiety being the same or different, such that n is 1, 2 or 3;

provided that at least one of $Z_1$ to $Z_4$ is an unsubstituted or substituted carbon atom;

L comprises one or more alkenyl groups which form part of an unsubstituted or substituted 5- to 10-membered ring system, which may contain one or more other heteroatoms selected from nitrogen, oxygen and sulfur; and Y is as defined for formula (I).

More particularly $Z_2$ and $Z_4$ are unsubstituted or substituted carbon atoms and L is an optionally substituted phenyl group.

In a further preferred embodiment the de-aggregating compound has the formula (IC)

(IC)

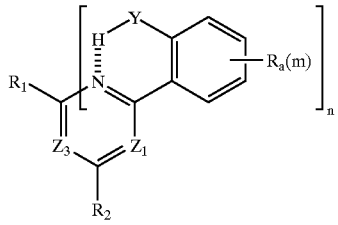

wherein $R_1$ and $R_2$ are independently hydrogen or a substituent;

each $R_a$ is an independently selected substituent;

m is 0 to 4; and $Z_1$ and $Z_3$ are independently nitrogen atoms or unsubstituted or substituted carbon atoms each of which together with an adjacent substituted carbon atom may support an additional hydrogen-bond-containing moiety, each moiety being the same or different, such that n is 1, 2 or 3; and Y is as defined for formula (I).

In the compounds of formula (I), the hydrogen-bonding moieties may be the same or different. In particular, each Y may be different such that when, for example, n is 2 one of Y may be —O— and the other may be —$NSO_2R$. More preferably however in formula (IC) each Y is —O—, $Z_1$ and $Z_3$ are both nitrogen atoms and n is 1 or 2, such that the de-aggregating compound has a formula (ID) or, more preferably (IE), wherein the hydrogen-bonding accepting capability of the de-aggregating compound is provided by the nitrogen atoms of a triazine nucleus and the hydroxyphenyl group(s) attached to one or two of the carbon atoms of the triazine moiety enable intramolecular hydrogen-bonding to occur. In compounds of formula (IE), the presence of the two hydrogen bonds advantageously increases the planarity of the de-aggregating agents.

(ID)

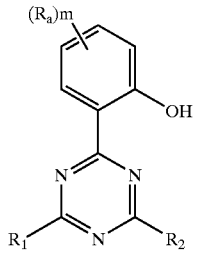

(IE)

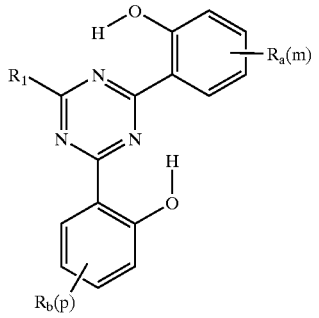

In compounds of formulae (ID) and (IE), $R_1$, $R_2$, $R_a$ and m are as defined for formula (IC);

each $R_b$ is an independently selected substituent; and p is 0 to 4.

In formulae (IC) to (IE), substituents for $R_1$, $R_2$, each $R_a$ and each $R_b$ are independently selected from cyano, fluoro, chloro, bromo, iodo; or an unsubstituted or substituted alkyl, aryl, heterocyclyl, alkoxy, aryloxy, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, alkyl- or aryl-thio, alkyl- or aryl phosphonate, nitro, alkyl- or aryl-amino, alkyl- or aryl-ureido or alkyl- or aryl-carbamoyl group, any of which may be further substituted, for example with one or more other such substituents.

When one or more of the above groups is an alkoxy group it may suitably be substituted with, for example, one or more hydroxy and/or an alkoxy groups, which may in turn be further substituted. An alkyl group may typically be substituted by halogen, or by a hydroxy, alkoxy, carbonamido or an alkoxycarbonyl group. An aryl group may be, for example, a naphthyl group but more especially a phenyl ring and a heterocyclic group may be, for example, a pyridyl, thienyl, morpholino, imidazolyl or pyridazolyl ring.

Alternatively any of $R_1$, $R_2$ and $R_a$ or $R_1$, $R_a$ and $R_b$ may join to form a dimer or polymer. However preferably each $R_a$ and each $R_b$ is independently an unsubstituted or substituted alkyl, alkoxy or alkoxycarbonyl or alkylcarbamoyl group whilst $R_1$ and $R_2$ are more preferably independently an alkyl group but more especially one of $R_1$ and $R_2$ is a phenyl group, substituted for example with one or more halogen or alkoxy, alkyl, alkylsulfonamido or alkylsulfonyl groups, more preferably in the ortho and/or para positions, and these groups may be further substituted.

m and p can be independently 0 to 4, preferably 0 to 2, more preferably 1 and, when present, is preferably para or more especially meta to Y.

The following examples further illustrate de-aggregating compounds of formula (I) that can be used in the invention, but the invention is not to be considered as limited to these compounds.

I-1
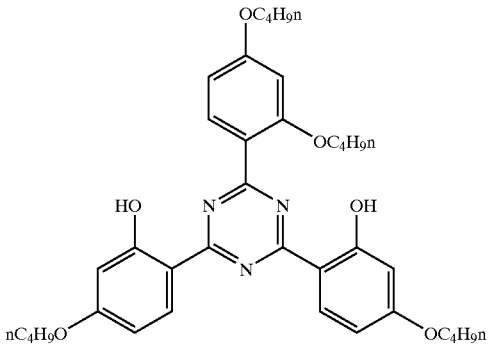
I-2
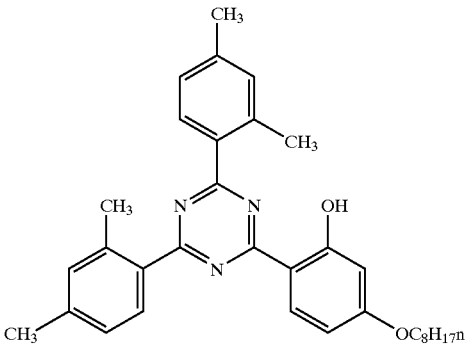
I-3
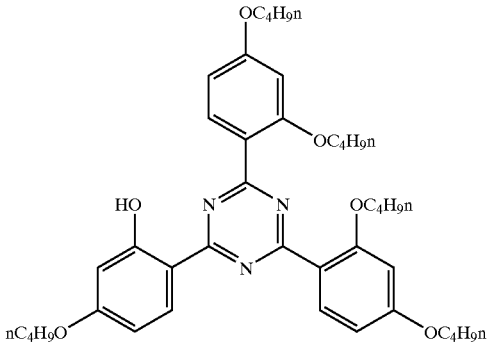
I-4
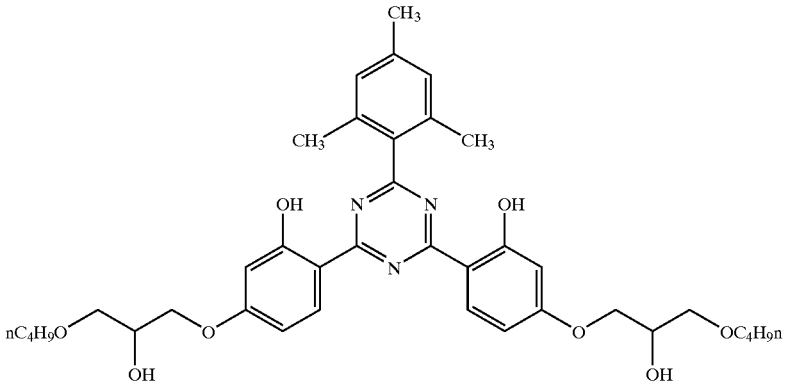
I-5
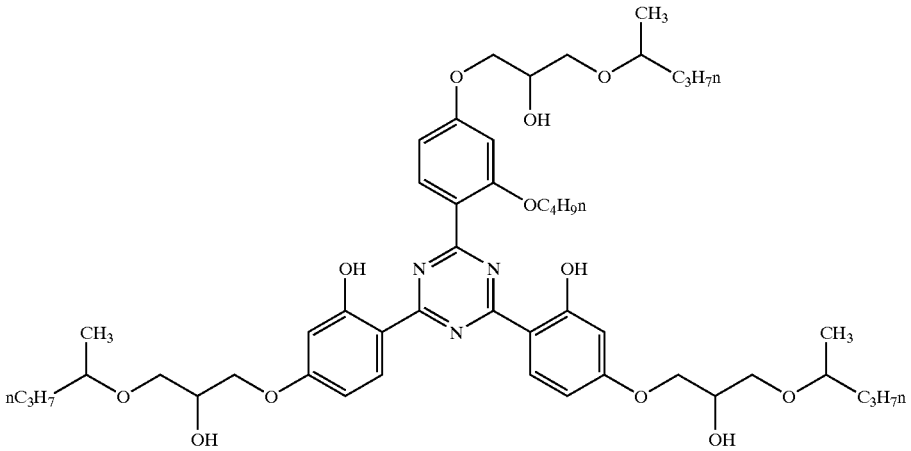

-continued
I-6
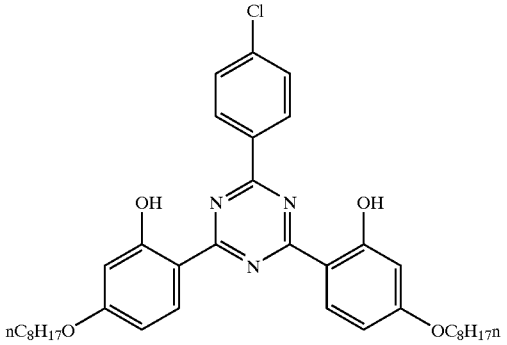
I-7
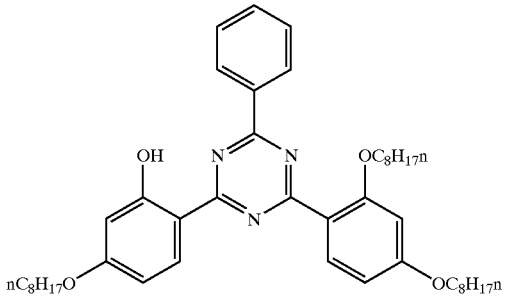
I-8
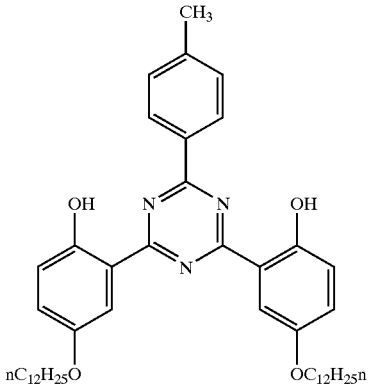
I-9
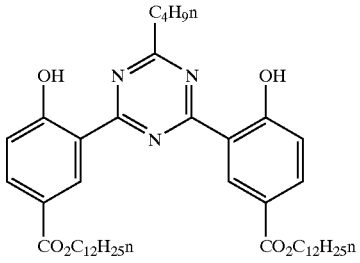
I-10
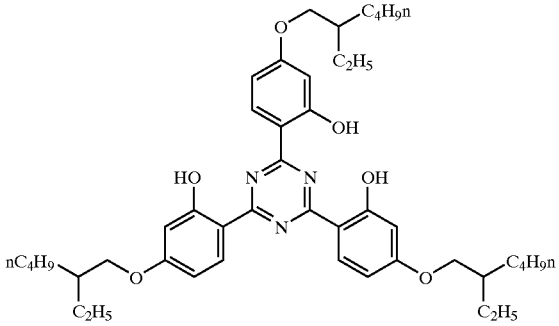
I-11
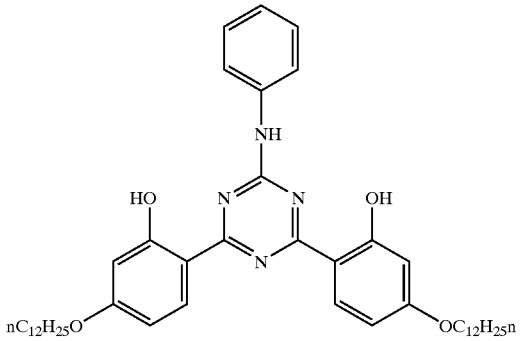
I-12
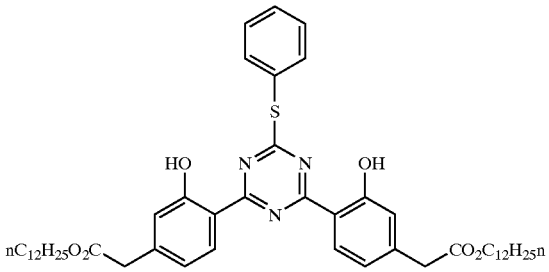
I-13
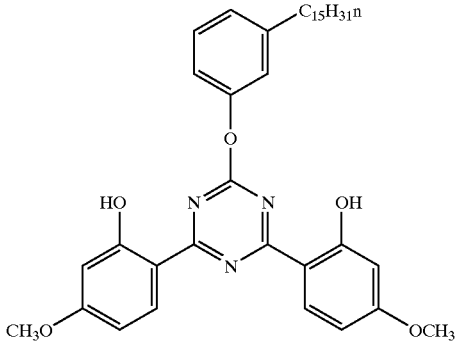

-continued
I-14
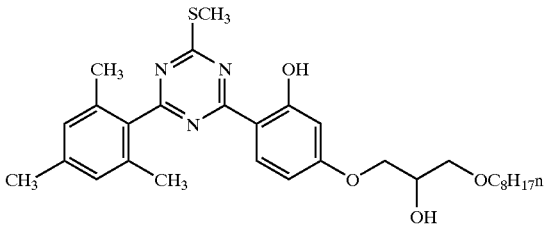
I-15
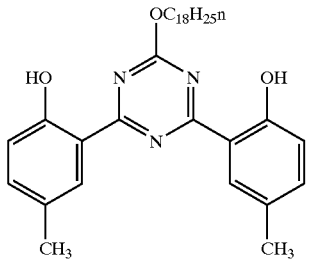
I-16
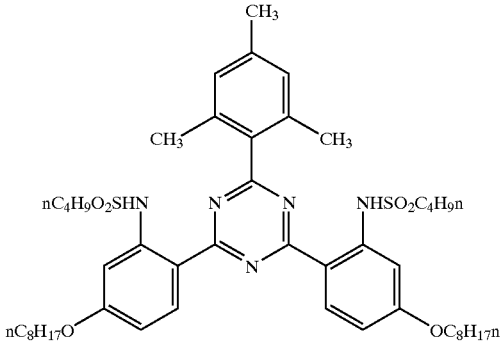
I-17
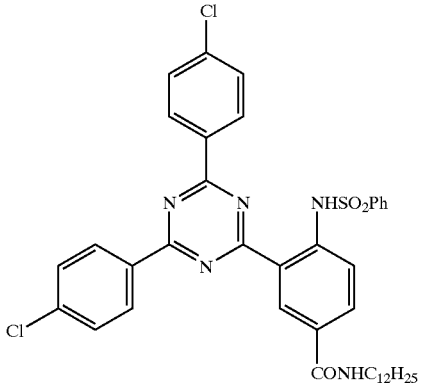
I-18
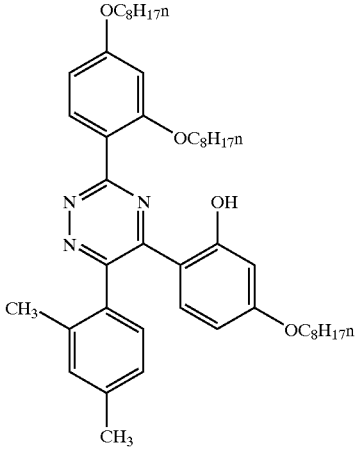
I-19
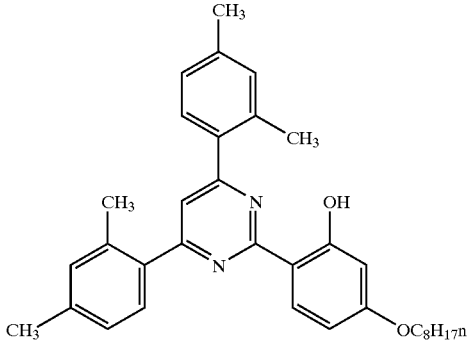
I-20
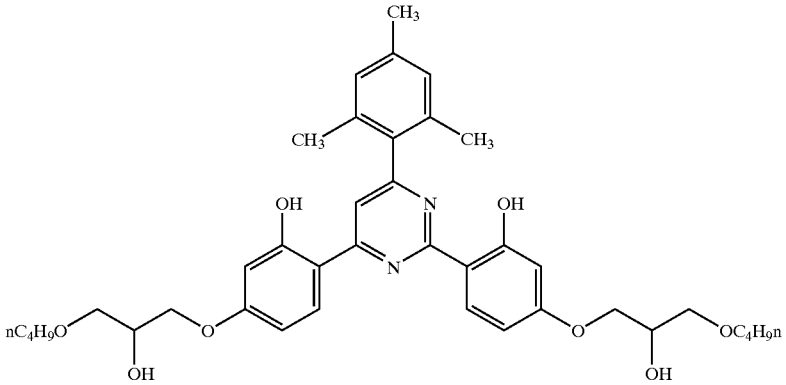

-continued
I-21
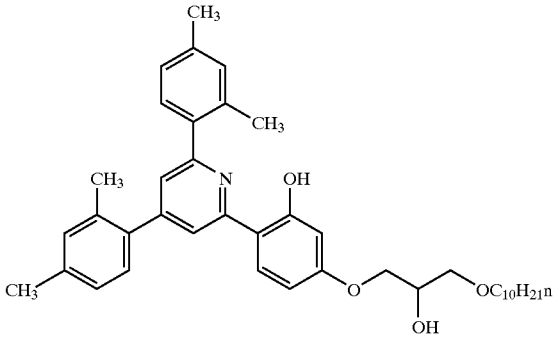
I-22
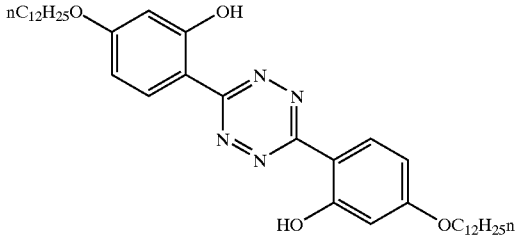
I-23
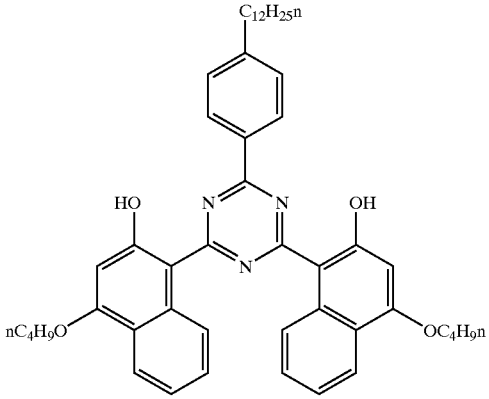
I-24
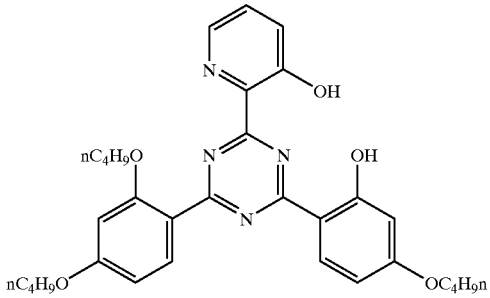
I-25
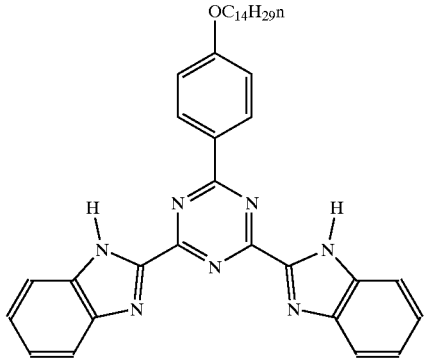
I-26
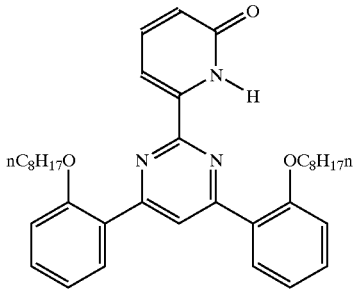
I-27
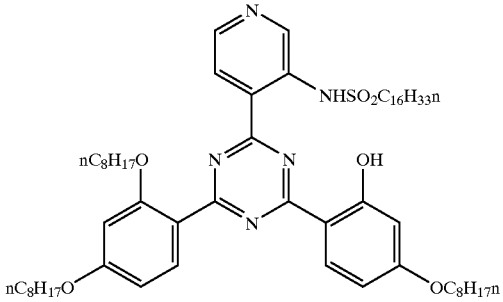
I-28
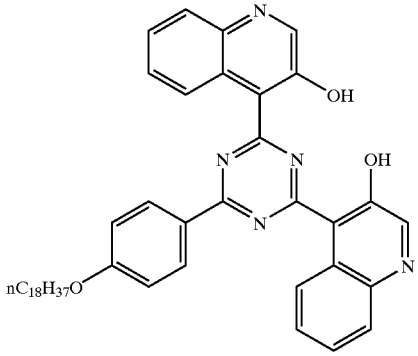

-continued
I-29
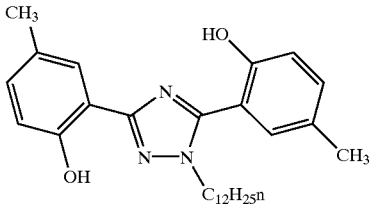
I-30
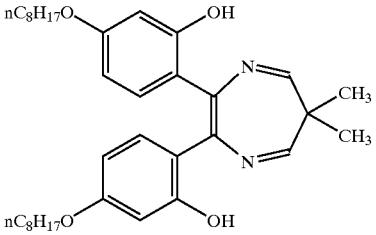
I-31
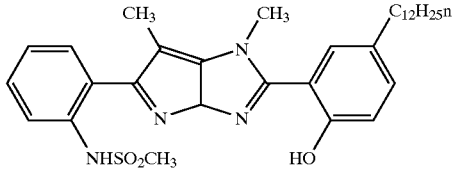
I-32
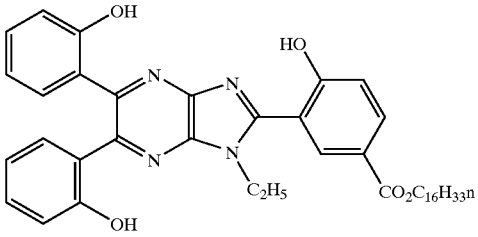
I-33
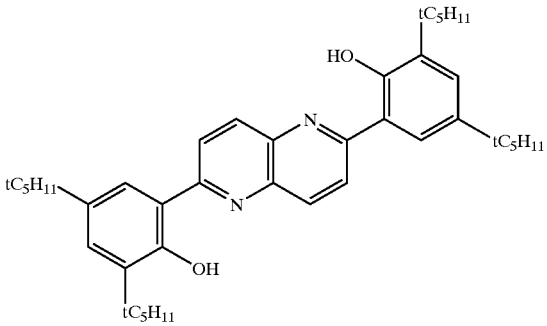
I-34
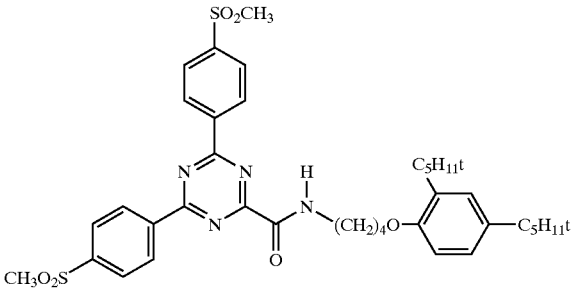
I-35
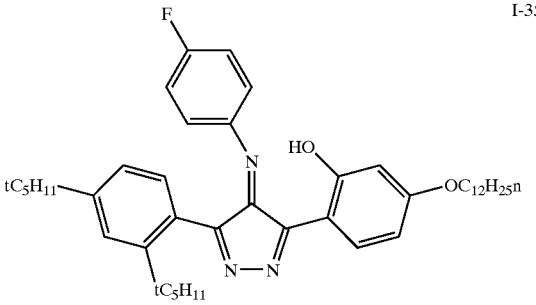
I-36
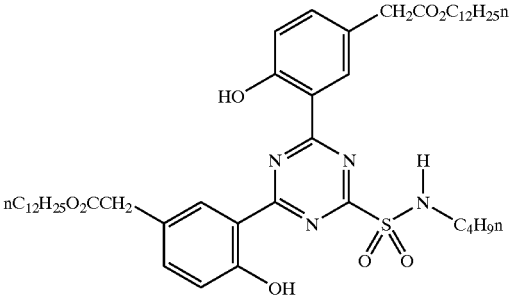
I-37
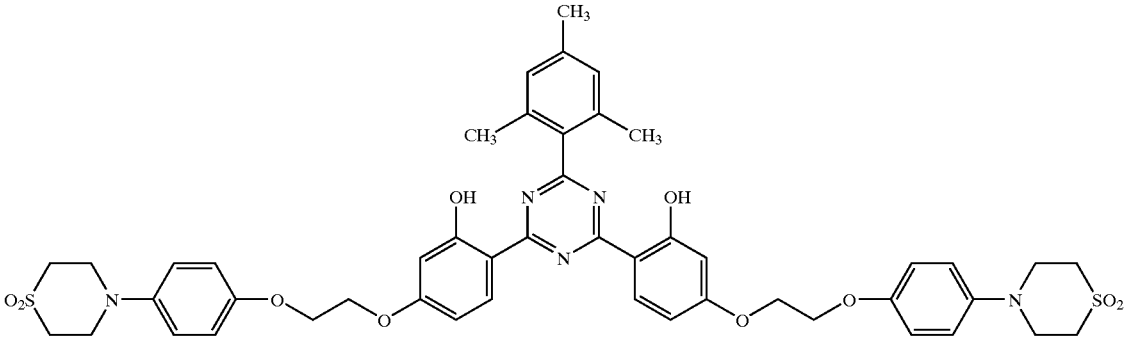

-continued

I-38

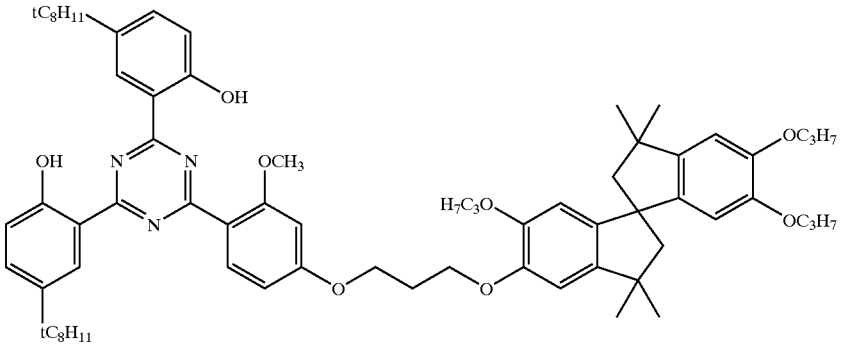

According to the invention a compound of formula (I) is combined with a heterocyclic cyan dye-forming coupler of formula (II) having the structure:

(II)

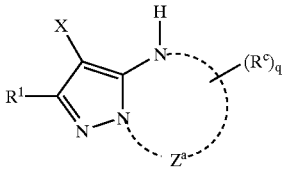

wherein $R^1$ is hydrogen or a substituent;

Rc is a substituent;

q is 0 to 4;

$Z^a$ represents the atoms necessary to complete an unsubstituted or substituted 5- to 10-membered heterocyclic ring system which may contain one or more other heteroatoms selected from nitrogen, oxygen and sulfur, providing that each $R^c$ is attached to a carbon atom of the ring; and X is selected from hydrogen or halogen or a group which is separable by the reaction of coupler with an oxidized colour developing agent.

One embodiment of a compound of formula (II) has the formula (IIA)

(IIA)

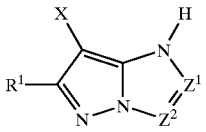

wherein $R_1$ and X are as defined for formula (II);

$Z^1$ and $Z^2$ are independently —CH— groups, which may together form part of an unsubstituted or substituted phenyl ring, —CR— groups, wherein R is a substituent, or nitrogen atoms.

Structures falling within formula (IIA) may, for example, be one of the following:

(a)

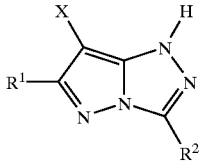

(b)

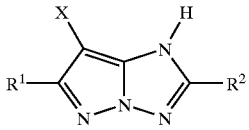

(c)

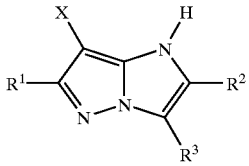

(d)

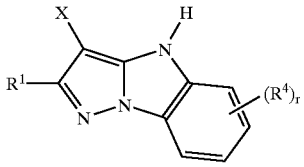

wherein each of $R^1$ to $R^4$ is hydrogen or an independently selected substituent;

r is 0 to 4; and

X is as defined for formula (II).

Alternatively the compound of formula (II) may have the structure (IIB)

(IIB)

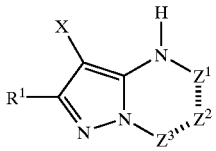

wherein one of $Z^1$ and $Z^3$ is a carbonyl or sulfonyl group and the other is a —CH— or —CR— group, wherein R is a substituent, or a nitrogen atom;

$Z^2$ is a —CH— or —CR— group or a nitrogen atom; or $Z^2$ and the other of $Z^1$ and $Z^3$ may together form an unsubstituted or substituted aryl ring or a 5–10 membered heterocyclic ring which may contain one or more heteroatoms selected from nitrogen, oxygen and sulfur, which ring is unsubstituted or substituted.

Structures falling within formula (IIB) may, for example, be one of the following:

(e)

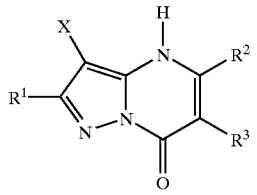

(f)

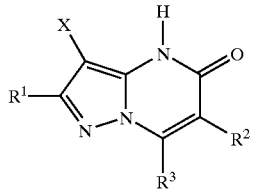

(g)

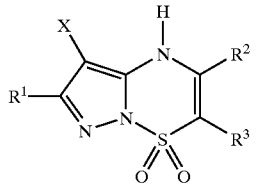

(h)

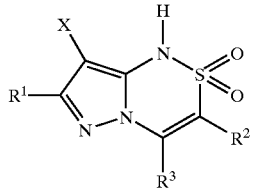

(i)

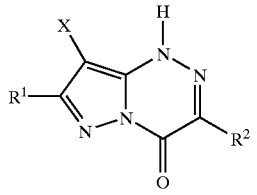

(j)

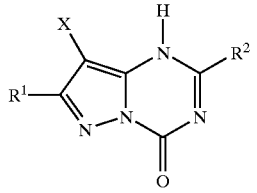

wherein each of $R^1$ to $R^3$ is hydrogen or an independently selected substituent or $R^2$ and $R^3$ may join to form an unsubstituted or substituted aryl ring or a 5- to 10-membered heterocyclic ring which contains one or more heteroatoms selected from nitrogen, oxygen and sulfur, which ring is unsubstituted or substituted; and X is as defined for formula (II).

Substituents for $R^1$, $R^2$, $R^3$ and $R^4$ may be independently selected from cyano, fluoro, chloro, bromo, iodo; or an unsubstituted or substituted alkyl, aryl, heterocyclyl, alkoxy, aryloxy, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, alkyl- or aryl-thio, alkyl- or aryl-phosphonate, nitro, alkyl- or aryl-amino, alkyl- or aryl-ureido or alkyl- or aryl-carbamoyl group, any of which may be further substituted, for example with one or more other such substituents.

Preferably $R^1$ is selected from a cyano or an unsubstituted or substituted alkyl (including trifluoromethyl), aryl, alkyl- or aryl-sulfonyl, alkyl- or aryl-sulfonamido, alkyl- or aryl-carbonamido or alkyl- or aryl-amino group or $R^1$ may be a heterocyclyl group such as, for example, a pyridyl, thienyl, thiazolyl or benzothiazolyl group. More preferably $R^1$ is an alkyl- or aryl-carbonamido or an alkyl- or aryl-carbamoyl group substituted, for example, with an alkyl, alkoxy, aryl, or an aryloxy group, any of which may be further substituted.

$R^2$and $R^3$ are preferably independently selected from an alkyl, aryl, arylcarbamoyl, alkoxycarbonyl, alkylcarbonamido and trifluoromethyl group but one of $R^2$ and $R^3$ is more particularly a phenyl group optionally substituted for example, with one or more halogen, alkyl, alkoxycarbonyl, alkylsulfamoyl, alkyl- or aryl-sulfonamido, alkylcarbonamido or alkylsulfonyl groups, any of which may be further substituted. Alternatively $R^2$ and $R^3$ may join to form an unsubstituted or substituted phenyl ring and each $R^4$ may be independently, for example, a halogen or unsubstituted or substituted alkylsulfamoyl group.

X is hydrogen or a coupling-off group, suitably a halogen atom or a group linked by an atom of sulfur, oxygen or nitrogen, such as an alkoxy, unsubstituted or substituted aryloxy, arylthio, azolyl, substituted mercaptotetrazole or thiopropionic acid. Chloro groups are conveniently employed.

The presence or absence of such groups determines the chemical equivalency of the coupler, i.e. whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation and colour correction.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio and arylazo. These coupling-off groups are described in the art, for example, in U.S. Pat. Nos. 2,455,169, 3,227,551, 3,432,521, 3,467,563, 3,617,291, 3,880,661, 4,052,212 and 4,134,766; and in UK Patent Nos. and published applications 1,466,728, 1,531,927, 1,533,039, 2,066,755A and 2,017,704A, the disclosures of which are incorporated herein by reference. Halogen, alkoxy and aryloxy groups are most suitable.

Examples of suitable coupling-off groups are —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

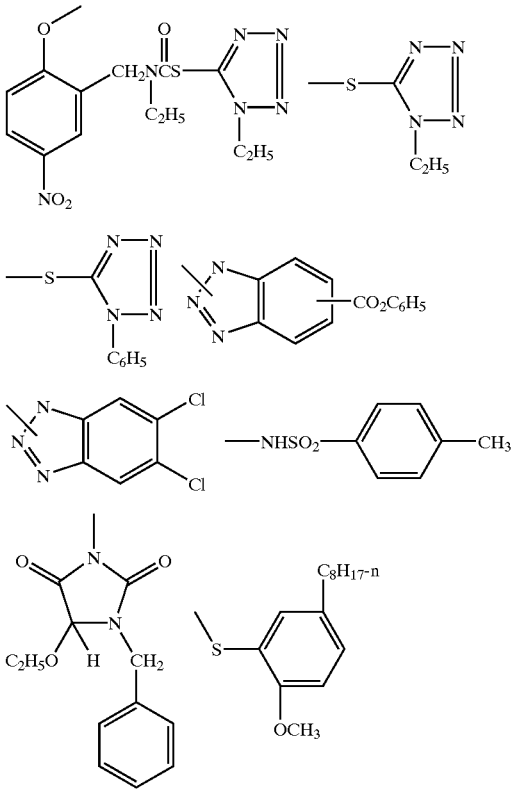
-continued
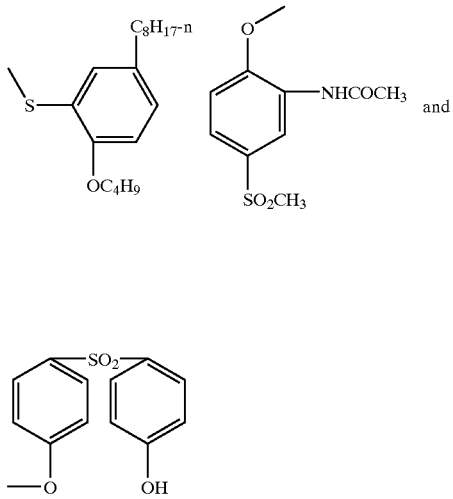
Typically the coupling-off group is a chlorine atom, hydrogen or a p-methoxy-phenoxy group.
The following examples further illustrate heterocyclic cyan dye-forming couplers that may be used in the invention. It is not to be construed that the present invention is limited to these examples.
C-1
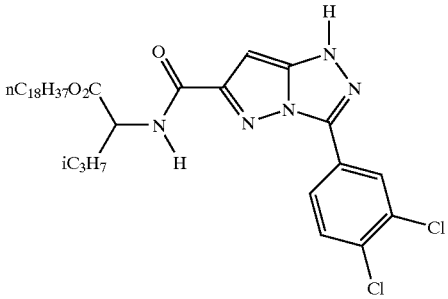
C-2
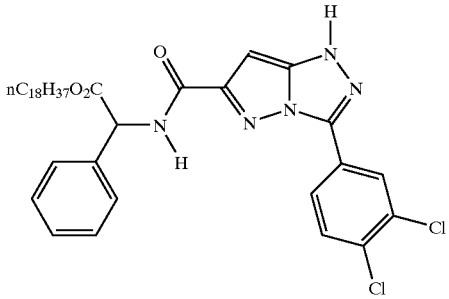
C-3
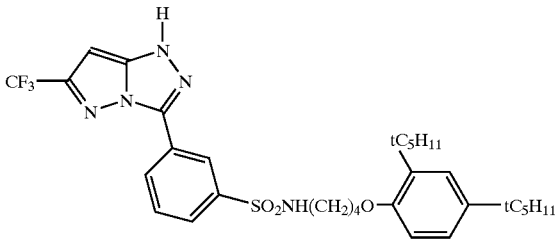
C-4
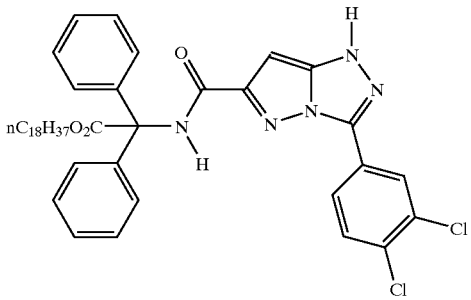

-continued
C-5
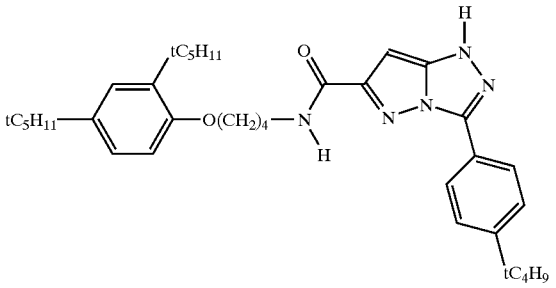
C-6
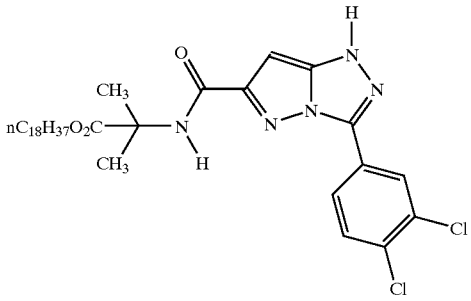
C-7
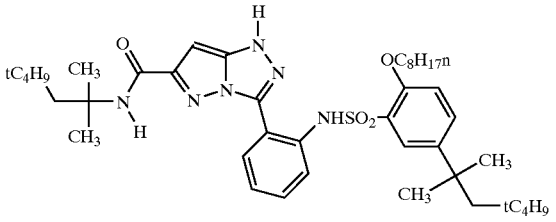
C-8
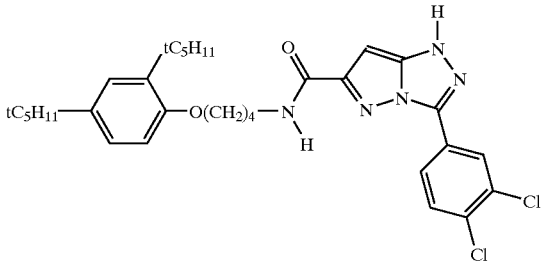
C-9
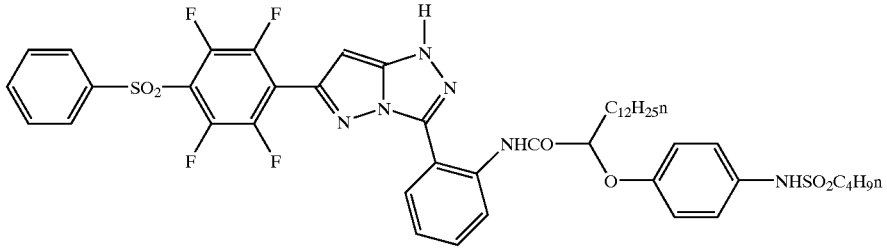
C-10
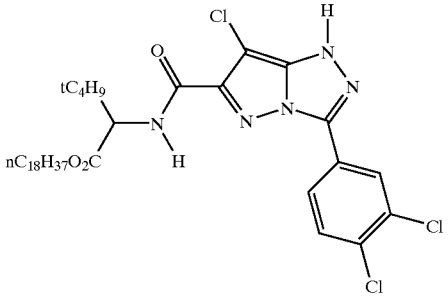
C-11
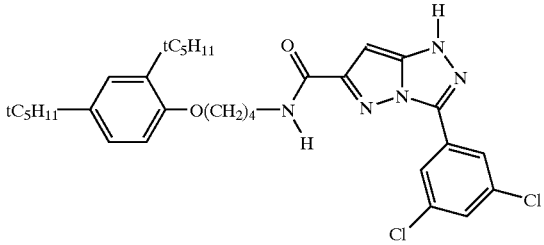
C-12
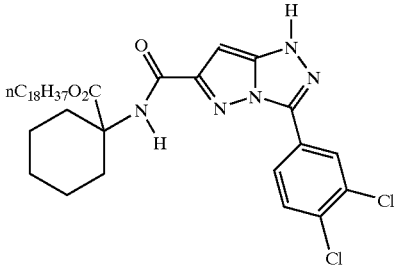
C-13
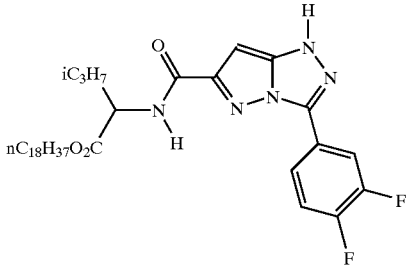

-continued
C-14
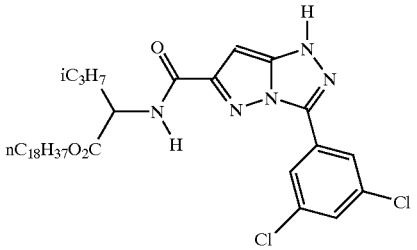
C-15
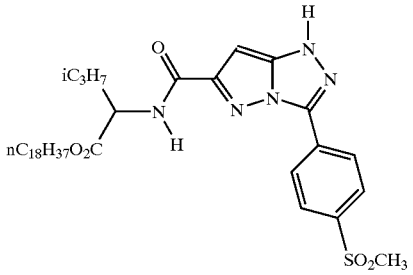
C-16
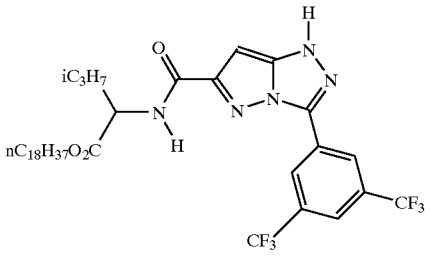
C-17
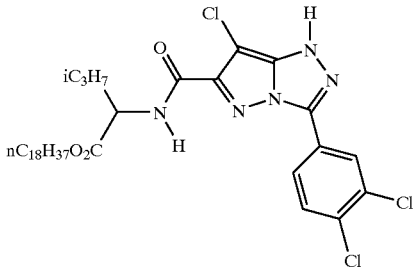
C-18
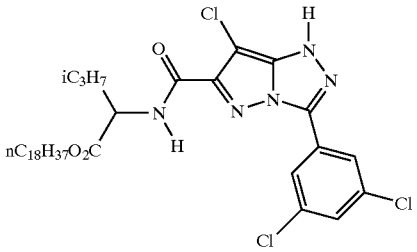
C-19
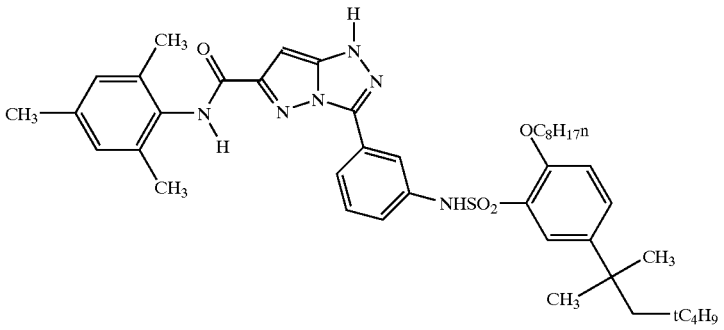
C-20
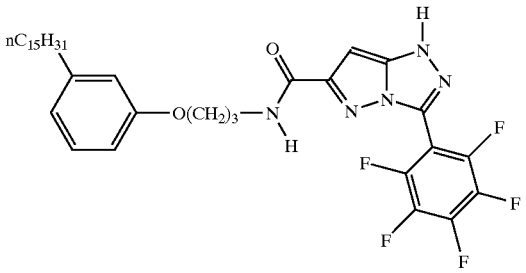

-continued
C-21
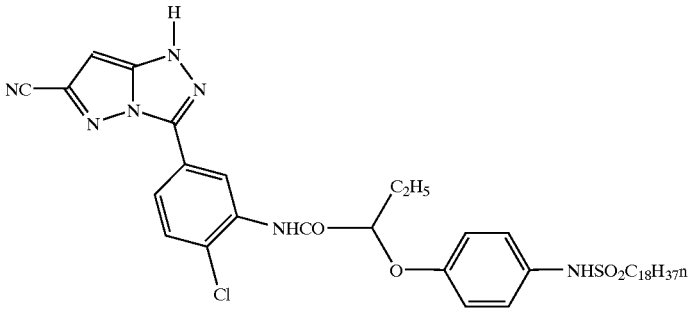
C-22
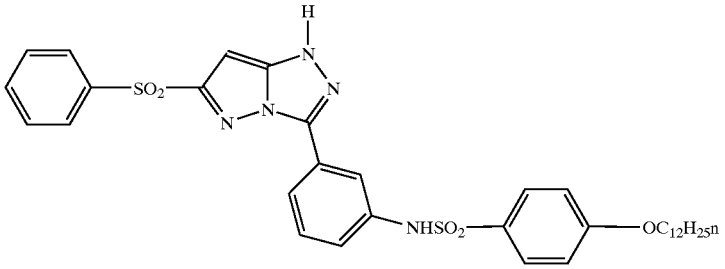
C-23
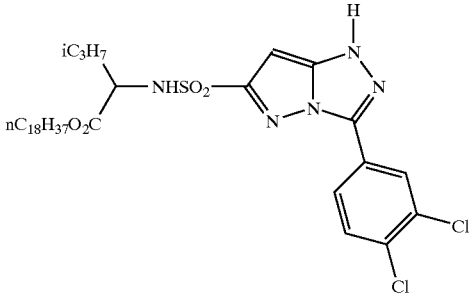
C-24
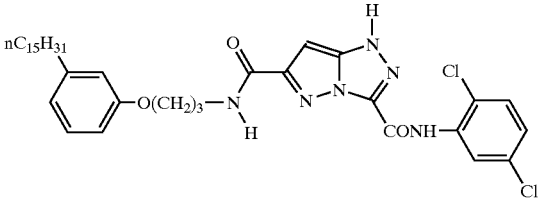
C-25
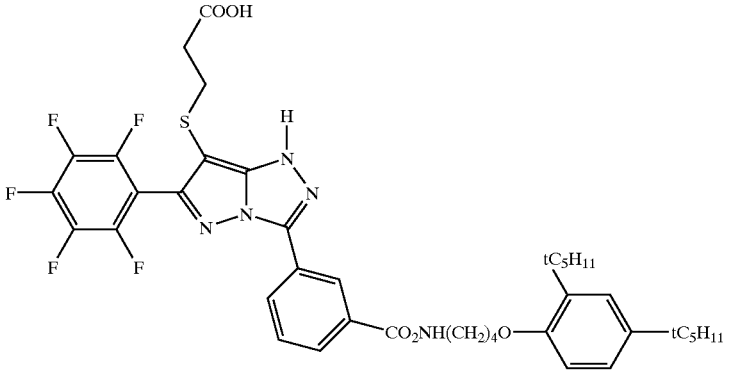

-continued
C-26
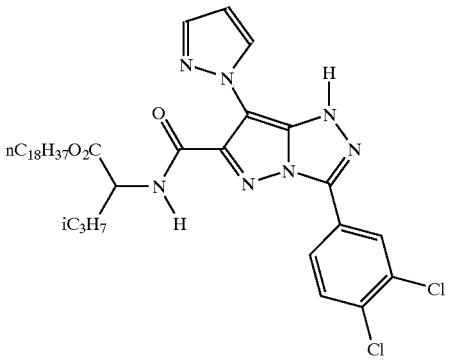
C-27
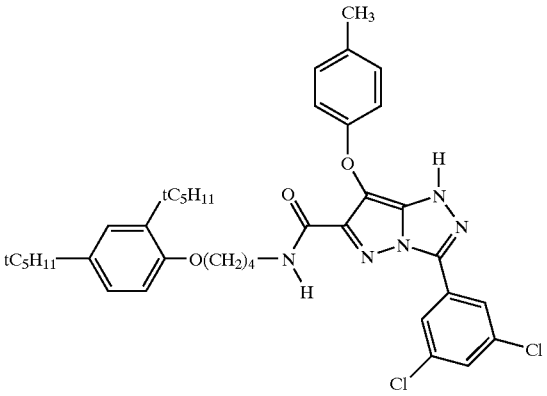
C-28
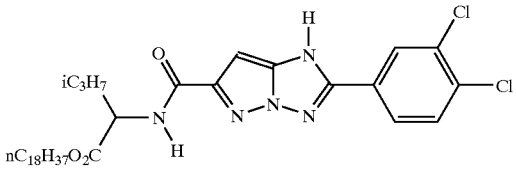
C-29
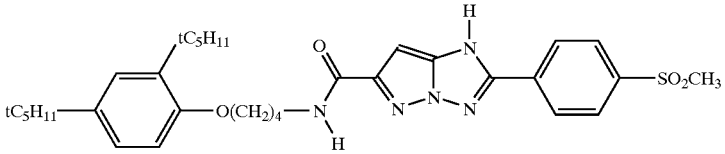
C-30
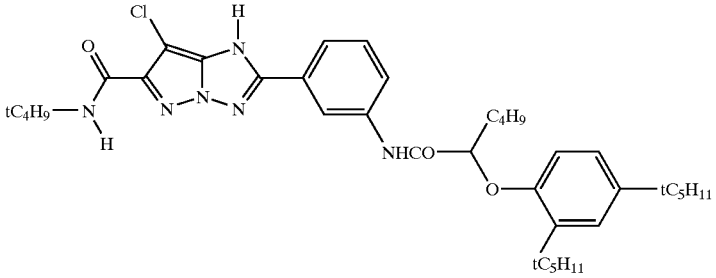
C-31
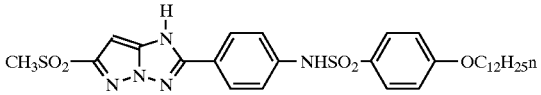
C-32
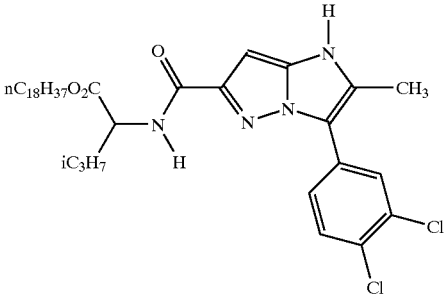
C-33
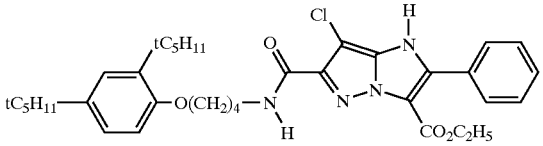
C-34
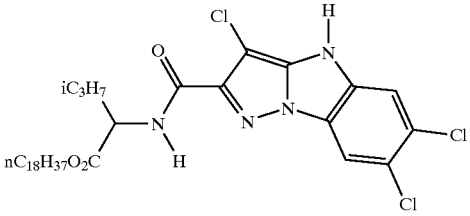

-continued
C-35
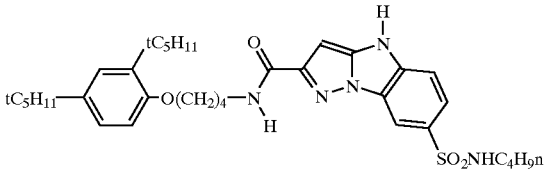
C-36
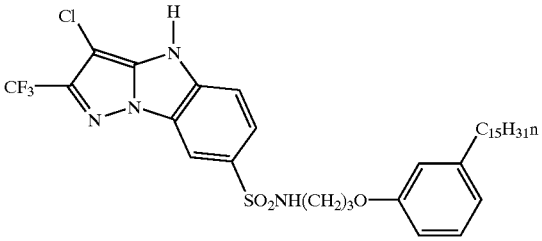
C-37
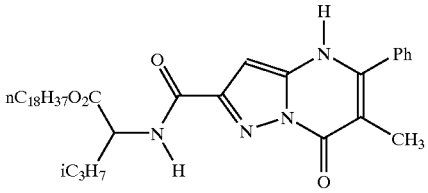
C-38
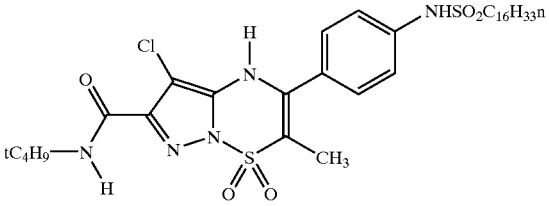
C-39
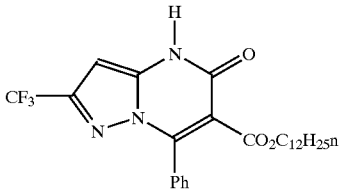
C-40
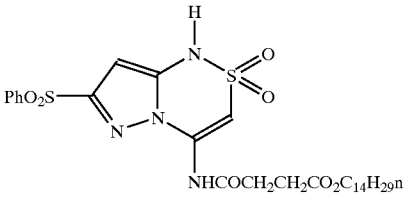
C-41
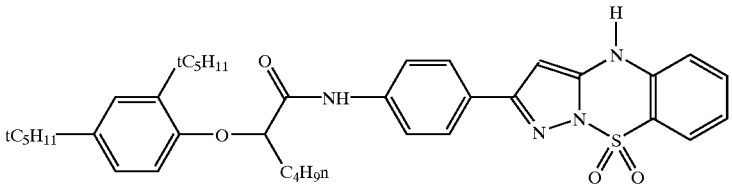
C-42
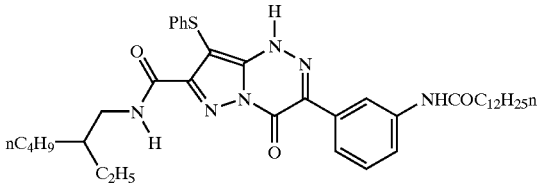
C-43
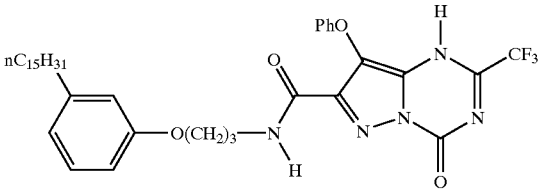
C-44
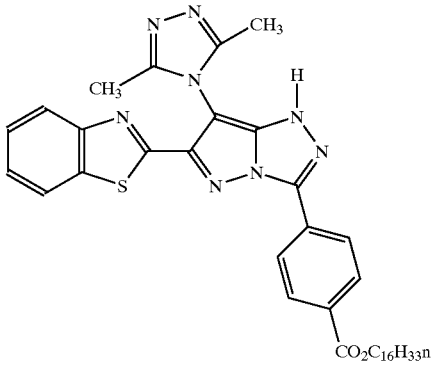
C-45
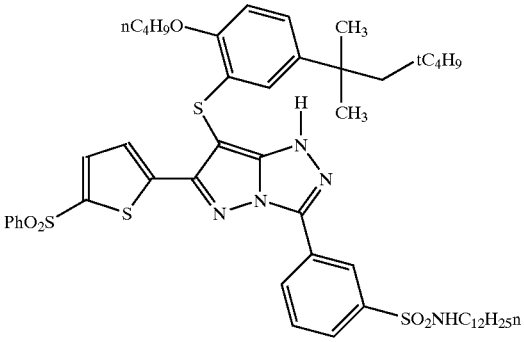

-continued

C-46

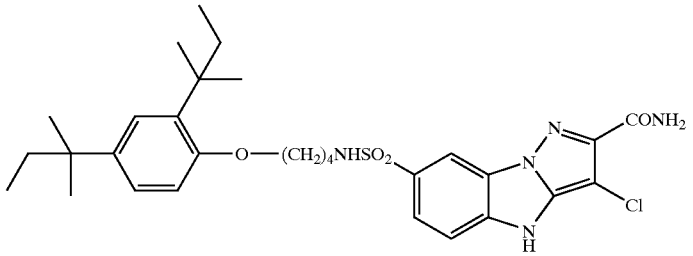

The stabilizer has the formula (III):

(III)

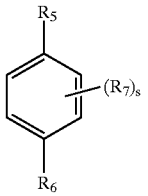

wherein $R_5$ is an electron-donating group;

$R_6$ is a substituent;

each $R_7$ is an independently selected substituent; or one of $R_5$ and $R_6$ may join with $R_7$ to form an unsubstituted or substituted 5- to 10-membered ring system which may contain one or more heteroatoms selected from nitrogen, oxygen and sulfur; and s is 0 to 4;

provided that (a) when one of $R_5$ and $R_6$ is a hydroxy group then the other may not be an arylsulfonamido or arylsulfamoyl substituent, and (b) at least one of $R_5$, $R_6$ and $R_7$ contains a ballast group comprising at least 8 carbon atoms.

In a preferred embodiment $R_5$ is a hydroxy or an unsubstituted or substituted alkyl, aryl, alkoxy, aryloxy, alkyl- or aryl-oxycarbonyl, alkyl- or aryl-oxycarbonylamino, alkoxycarbonyloxy, mono- and di-alkylamino, (including pyrrolidino, morpholino, and thiomorpholine dioxide), arylamino, alkyl- or aryl-ureido, alkyl- or aryl-sulfonyloxy, alkyl- or aryl-oxysulfonyl, alkyl- or aryl-thio, alkyl- or aryl-sulfamoylamino or an alkyl- or aryl-sulfonamido group, any of which may be further substituted, for example with one or more other such substituents.

$R_6$ may be the same as $R_5$ but may additionally be O-phosphonate, O-silyl or an electron-withdrawing group, such as an arylsulfone or carboxylate ester group.

More preferably at least one of $R_5$ and $R_6$ is an alkoxy group, optionally substituted with, for example, an alkoxycarbonyl group, a dialkylamino group (including a thiomorpholine dioxide group) or an unsubstituted or substituted alkyl or alkylsulfonamido group.

Each $R_7$, when present, is independently a cyano, fluoro, chloro, bromo, iodo; or an unsubstituted or substituted alkyl, aryl, heterocyclyl, alkoxy, aryloxy, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, alkyl- or aryl-thio, alkyl- or aryl-phosphonate, nitro, alkyl- or aryl-amino, alkyl- or aryl-ureido or alkyl- or aryl-carbamoyl group, any of which may be further substituted, for example with one or more other such substituents.

Preferably s is 0, 1 or 2. When s is other than 0, $R_7$ is more preferably one or more halogen atoms or an alkyl, especially a secondary or tertiary alkyl, or alkoxy group. Alternatively one of $R_5$ and $R_6$ may combine with $R_7$ to form an unsubstituted or substituted 5- to 10-membered ring, for example a benzo or pyran ring, which may be substituted.

It is important that the substituent groups $R^1$ to $R^7$, $R^c$ and X of the coupler and stabilizer are selected so as to adequately ballast the coupler and the resulting dye in the organic solvent in which the coupler is dispersed and also to ballast the stabilizer. The ballasting may be accomplished by providing hydrophobic substituent groups in one or more of these substituent groups. Generally a ballast group is an organic radical of such size and configuration as to confer on the coupler and stabilizer molecules sufficient bulk and aqueous insolubility as to render them substantially nondiffusible from the layer in which they are coated in a photographic element. Thus the combination of these substituent groups in the couplers and stabilizers for use in the invention are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. Furthermore, even if the coupling-off group X in the coupler contains a ballast it is often necessary to ballast the other substituents as well, since X is eliminated from the molecule upon coupling.

The following examples further illustrate stabilizers that may be used in the invention. It is not to be construed that the present invention is limited to these examples.

ST-1

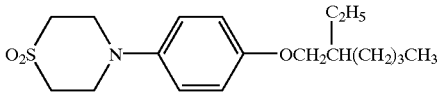

ST-2

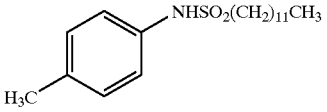

-continued
ST-3
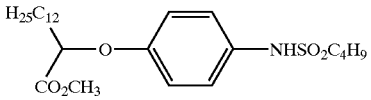
ST-4
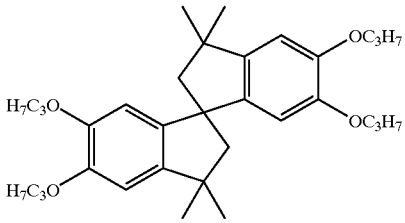
ST-5
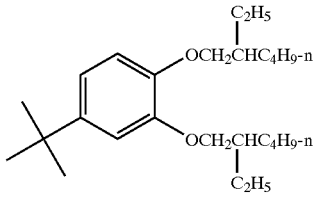
ST-6
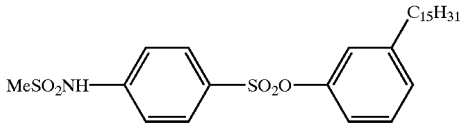
ST-7
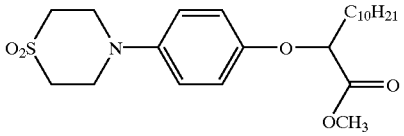
ST-8
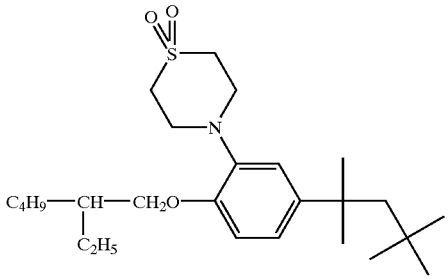
ST-9
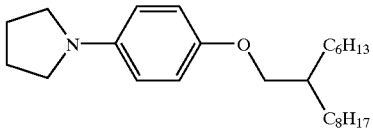
ST-10
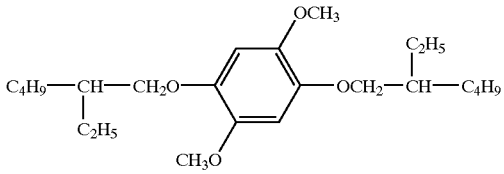
ST-11
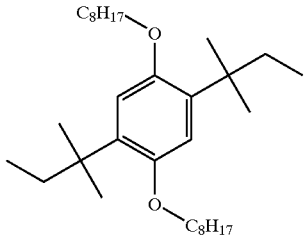
ST-12
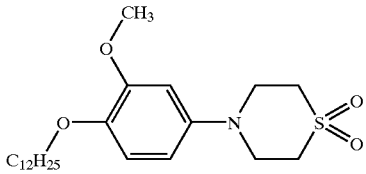
ST-13
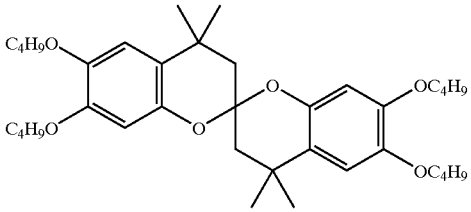
ST-14
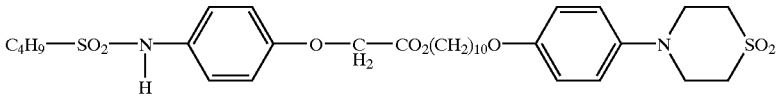
ST-15
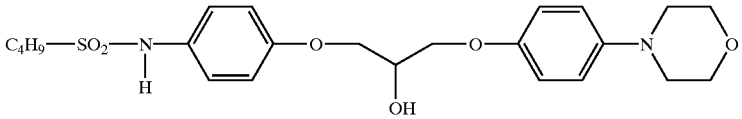

-continued
ST-16
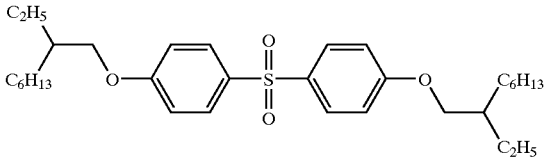
ST-17
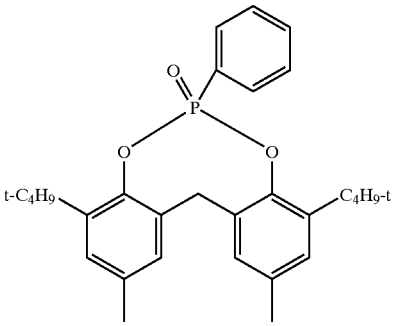
ST-18
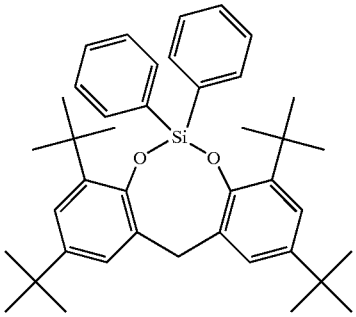
ST-19
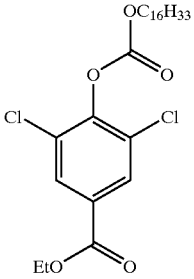
ST-20
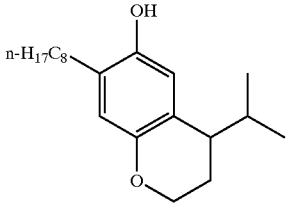
ST-21
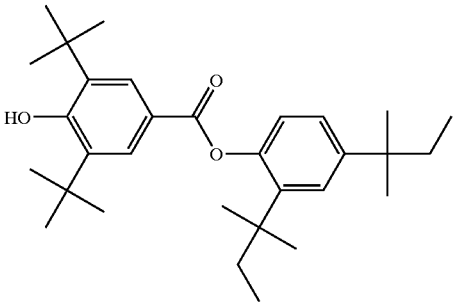
ST-22
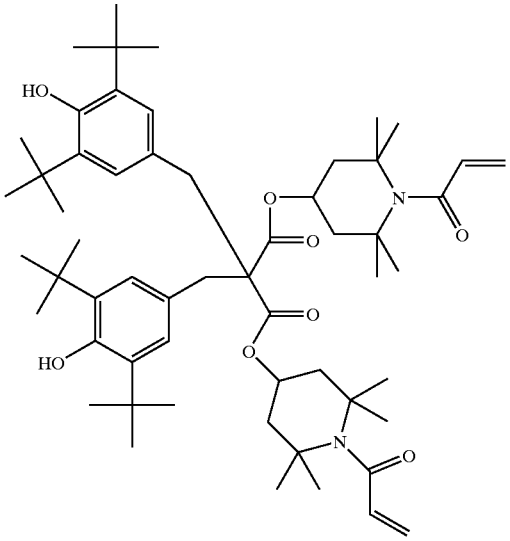
ST-23
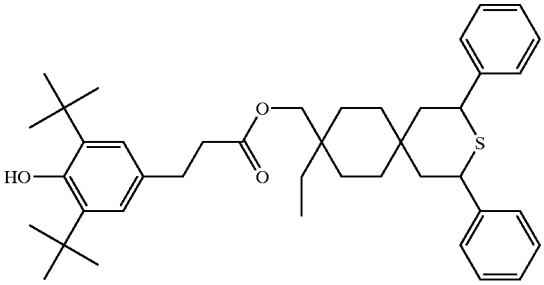

-continued

ST-24

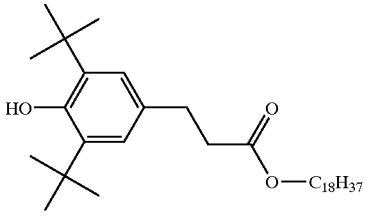

ST-25

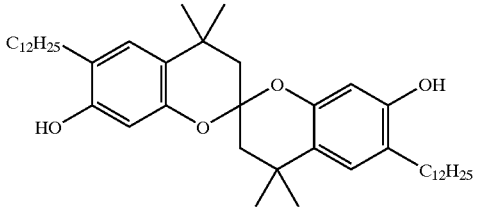

ST-26

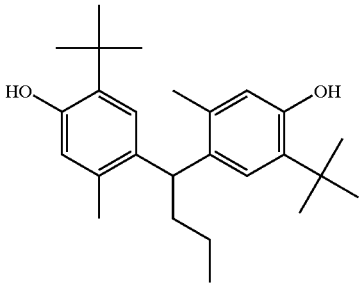

ST-27

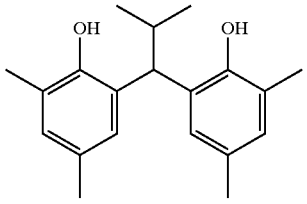

ST-28

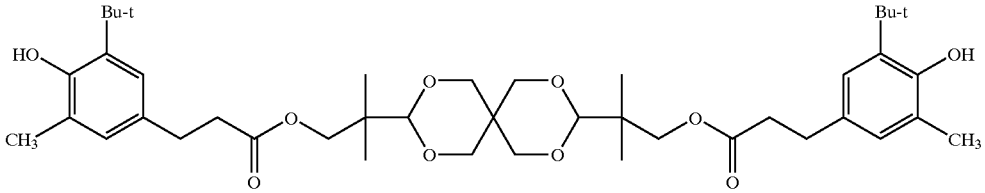

ST-29

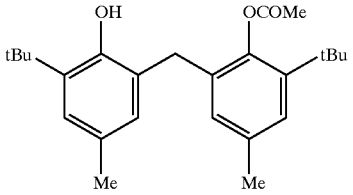

ST-30

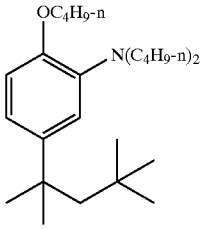

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy and 2-dodecyl-oxyethoxy; aryl such as phenyl, 4-t-butyl-phenyl, 2,4,6-trimethylphenyl, naphthyl; aryloxy, such as phenoxy, 2-methylphenoxy, alpha- or beta-naphthyloxy and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl and N-dodecylsulfamoyl; carbamoyl, such as N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl and N,N-di-octylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl and p-toluylsulfonyl; sulfonyloxy, such as dodecylsulfonyloxy and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl and p-toluylsulfinyl; thio, such as ethylthio, octylthio, benzylthio, tetradecylthio, 2-(2,4-di-t-pentylphenoxy)-ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenylcarbamoyloxy, N-ethylcarbamoyloxy and cyclohexylcarbonyloxy; amino, such as phenylanilino, 2-chloroanilino, diethylamino and dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido and sulfamoyl groups wherein the substituents typically contain 1 to 42 carbon atoms. Such substituents can also be further substituted.

Embodiments of the invention exhibit reduction of low unwanted side-band absorption, providing a colour record having improved hue.

The dispersion of the coupler(s), for use in the invention can be incorporated into the photographic element as emulsified photographic dispersions, prepared by dissolving the materials in one or more high-boiling permanent organic solvents, preferably, for example, tributyl citrate, with or without a low-boiling or partially water-soluble auxiliary organic solvent. Normally the solvent will be other than a phenol substituted at the para position with a nitrogen- or sulfur-bonded group. A blend of permanent solvents may be advantageous to optimise the desired features, such as solubility, dye hue, thermal or light stability or the coupling reactivity of the dispersions.

The resulting organic solution may then be mixed with an aqueous gelatin solution and the mixture passed through a mechanical mixing device suitable for high-shear or turbulent mixing generally suitable for preparing photographic emulsified dispersions, as described in EP-A-1 037 103, incorporated herein by reference. The dispersion particles preferably have an average particle size of less than 2 $\mu$m, generally from about 0.02 to 2 $\mu$m, more preferably from about 0.02 to 0.5 $\mu$m, especially from about 0.02 to 0.3 $\mu$m. These methods are described in detail in U.S. Pat. Nos. 2,322,027, 2,787,544, 2,801,170, 2,801,171, 2,949,360 and 3,396,027, the disclosures of which are incorporated by reference herein.

The aqueous phase of the coupler dispersion(s) for use in the invention preferably comprises gelatin as a hydrophilic colloid. This may be gelatin or a modified gelatin such as acetylated gelatin, phthalated gelatin or oxidized gelatin. Gelatin may be base-processed, such as lime-processed gelatin, or may be acid-processed, such as acid-processed ossein gelatin. Other hydrophilic colloids may also be used, such as a water-soluble polymer or copolymer including, but not limited to poly(vinyl alcohol), partially hydrolyzed poly(vinyl acetate-co-vinyl alcohol), hydroxyethyl cellulose, poly(acrylic acid), poly(1-vinylpyrrolidone), poly (sodium styrene sulfonate), poly(2-acrylamido-2-methane sulfonic acid) and polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-ionic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-iso-propyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis(2-ethylhexyl) succinic sulfonate.

Aqueous dispersions of high-boiling solvents can be prepared similarly to the coupler dispersion(s), e.g. by adding the solvent to an aqueous medium and subjecting such mixture to high shear or turbulent mixing as described above. The aqueous medium is preferably a gelatin solution, and surfactants may also be used as described above. Additionally, a hydrophobic additive may be dissolved in the solvent to prevent particle growth as described in U.S. Pat. No. 5,468,604, the disclosure of which is incorporated by reference. The mixture is then passed through a mechanical mixing device such as a colloid mill, homogenizer, microfluidizer, high-speed mixer or ultrasonic dispersing apparatus to form small particles of the organic solvent suspended in the aqueous phase. These methods are described in detail in the aforementioned references on dispersion making.

An aqueous coating solution in accordance with the present invention may then be prepared by combining the coupler dispersion(s) with the separate dispersion of the high-boiling organic solvent. Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g. 30 to 50C) for a short period of time (e.g. 5 min to 4 h) prior to coating.

The materials for use in the invention can be used in any of the ways and in any of the combinations known in the art. Typically, the materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized colour developing agent. Thus, as used herein, the term "associated" signifies that the compound is in the silver halide emulsion layer or in an adjacent location where, during processing, it is capable of reacting with silver halide development products.

Suitable laydowns of total coupler are from about 0.05 mmol/$m^2$ to about 1.5 mmol/$m^2$, preferably from about 0.15 mmol/$m^2$ to about 1 mmol/$m^2$, more preferably from about 0.30 mmol/$m^2$ to about 1 mmol/$m^2$. The molar ratio of de-aggregating compound of formula (I) to total coupler of formula (II) is from about 0.01:1 to about 4:1, preferably from about 0.25:1 to about 2:1, more preferably from about 0.4:1 to about 1.5:1. The ratio of solvent to total coupler (by weight) is from about 0.2:1 to about 5:1, preferably from about 0.5:1 to about 4:1, more preferably from about 0.5:1 to about 2:1. The ratio of stabilizer to total coupler (by weight) is from about 0.1:1 to about 4:1, preferably from about 0.1:1 to about 2:1, more preferably from about 0.25:1 to about 1.5:1.

The photographic elements comprising coupler dispersion (s) for use in the invention can be single colour elements or multicolour elements. Multicolour elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler.

The element can be employed with a reflective support, as described in U.S. Pat. No. 5,866,282. The element can contain additional layers, such as filter layers, interlayers, overcoat layers and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230 provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. colour negative, reversal or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials and physical property modifying addenda such as hardeners, coating aids, plasticizers, lubricants and matting agents are described, for example, in Sections II and VI through VIII. Colour materials are described in Sections X through XIII. Scan facilitating is described in Section XIV. Supports, exposure, development systems and processing methods and agents are described in Sections XV to XX. Certain desirable photographic elements and processing steps, particularly those useful in conjunction with colour reflective prints, are described in *Research Disclosure*, Item 37038, February 1995. U.S. Pat. No. 5,558,980 discloses loaded latex compositions, such as poly- and t-butylacrylamides which can be incorporated into any photographic coating in any layer to provide extra dye stability.

Couplers that form cyan dyes upon reaction with oxidized colour developing agents are typically phenols, naphthols or pyrazoloazoles, described in such representative patents and publications as U.S. Pat. Nos. 2,367,531, 2,423,730, 2,474,293, 2,772,162, 2,895,826, 3,002,836, 3,034,892, 3,041,236, 4,333,999 and 4,883,746, EP-A-0 544 322, EP-A-0 556 700, EP-A-0 556 777, EP-A-0 565 096, EP-A-0 570 006 and EP-A-0 574 948 and "Farbkuppler-eine Literature Übersicht," published in Agfa Mitteilungen, Band III, pp. 156–175 (1961).

Typical cyan couplers are represented by the following formulae:

CYAN-1

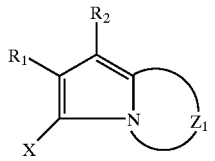

CYAN-2

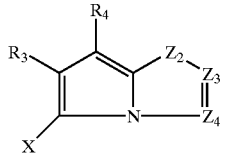

-continued

CYAN-3

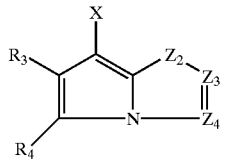

CYAN-4

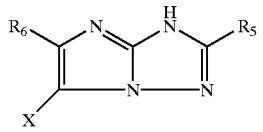

wherein $R_1$, $R_5$ and $R_8$ each represent a hydrogen or a substituent, $R_2$ represents a substituent, $R_3$, $R_4$ and $R_7$ each represent an electron attractive group having a Hammett's substituent constant $s_{para}$ of 0.2 or more and the sum of the $s_{para}$ values of $R_3$ and $R_4$ is 0.65 or more, $R_6$ represents an electron attractive group having a Hammett's substituent constant $s_{para}$ of 0.35 or more, X represents a hydrogen or a coupling-off group, $Z_1$ represents nonmetallic atoms necessary for forming a nitrogen-containing, six-membered, heterocyclic ring which has at least one dissociative group, $Z_2$ represents —C($R_7$)═ and —N═ and $Z_3$ and $Z_4$ each represent —C($R_8$)═ and —N═, or by the formulae:

CYAN-5

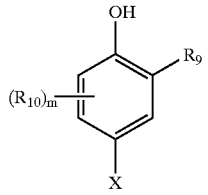

CYAN-6

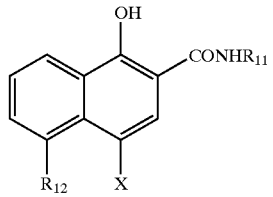

wherein $R_9$ represents a substituent (preferably a carbamoyl, ureido, or carbonamido group), $R_{10}$ represents a substituent (preferably individually selected from halogens, alkyl, and carbonamido groups), $R_{11}$ represents ballast substituent; $R_{12}$ represents a hydrogen or a substituent (preferably a carbonamido or sulfonamido group), X represents a hydrogen or a coupling-off group, and m is an integer from 1–3.

Couplers that form magenta dyes upon reaction with oxidized colour developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654 and "Farbkuppler-eine Literature Übersicht," published in Agfa Mitteilungen, Band III, pp. 126–156 (1961). Preferably such couplers are pyrazolones, pyrazolotriazoles or pyrazolobenzimidazoles that form magenta dyes upon reaction with oxidized colour developing agents.

Especially preferred couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493, 1,252,418, 1,398,979, U.S. Pat. Nos. 4,443,536, 4,514,490, 4,540,654, 4,590,153, 4,665,015, 4,822,730, 4,945,034, 5,017,465 and 5,023,170. Examples of 1H-pyrazolo[1,5-b]-1,2,4-triazoles can be found in EP-A-0 176 804, EP-A-0 177 765, U.S. Pat. Nos. 4,659,652, 5,066,575 and 5,250,400.

Typical pyrazoloazole and pyrazolone couplers are represented by the following formulae:

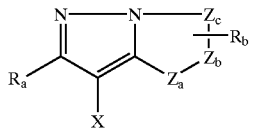

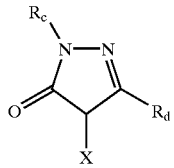

wherein $R_a$ and $R_b$ are independently hydrogen or a substituent, $R_c$ is a substituent (preferably an aryl group), $R_d$ is a substituent (preferably an anilino, carbonamido, ureido, carbamoyl, alkoxy, aryloxycarbonyl, alkoxycarbonyl, or N-heterocyclic group), X is hydrogen or a coupling-off group, and $Z_a$, $Z_b$, and $Z_c$ are independently a substituted methine group, ═N—, ═C— or —NH—, provided that one of either the $Z_a$-$Z_b$ bond or the $Z_b$-$Z_c$ bond is a double bond and the other is a single bond, and when the $Z_b$-$Z_c$ bond is a carbon-carbon double bond, it may form part of an aromatic ring, and at least one of $Z_a$, $Z_b$, and $Z_c$ is a methine group connected to the group $R_b$.

Specific examples of such couplers are:

M-1

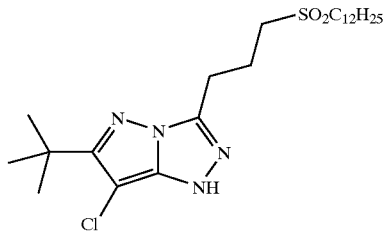

M-2

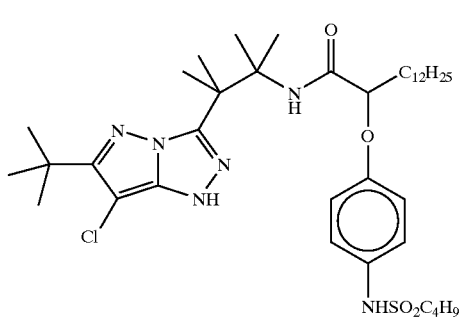

-continued

M-3

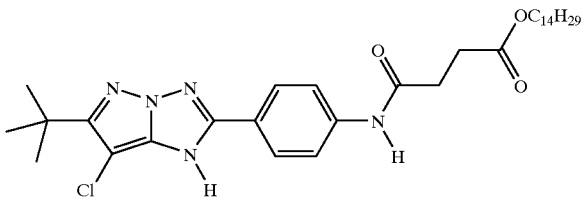

M-4

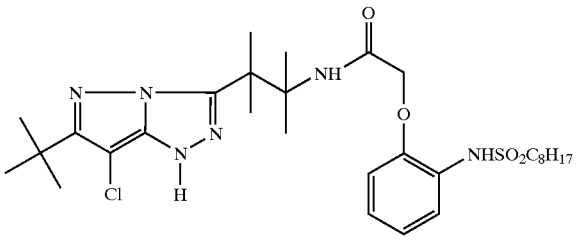

Couplers that form yellow dyes upon reaction with oxidized colour developing agent are described in such representative patents and publications as: U.S. Pat. Nos. 2,298,443, 2,407,210, 2,875,057, 3,048,194, 3,265,506, 3,447,928, 3,960,570, 4,022,620, 4,443,536, 4,910,126 and 5,340,703 and "Farbkuppler-eine Literature Übersicht", published in Agfa Mitteilungen, Band III, pp. 112–126 (1961). Such couplers are typically open chain ketomethylene compounds.

Also preferred are yellow couplers such as described in, for example, EP-A-0 482 552, EP-A-0 510 535, EP-A-0 524 540, EP-A-0 543 367 and U.S. Pat. No. 5,238,803. For improved colour reproduction, couplers which give yellow dyes that cut off sharply on the long wavelength side are particularly preferred (for example, see U.S. Pat. No. 5,360,713).

Typical preferred yellow couplers are represented by the following formulae:

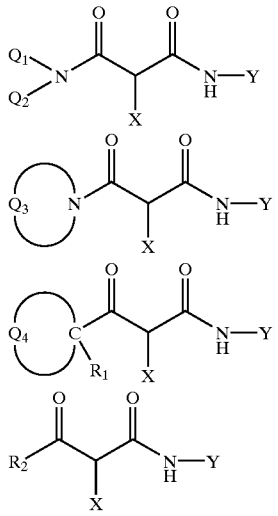

wherein $R_1$, $R_2$, $Q_1$ and $Q_2$ are each a substituent, X is hydrogen or a coupling-off group, Y is an aryl group or a heterocyclic group, $Q_3$ is an organic residue required to form a nitrogen-containing heterocyclic group together with the >N—, and $Q_4$ are nonmetallic atoms necessary to form a 3- to 5-membered hydrocarbon ring or a 3- to 5-membered heterocyclic ring which contains at least one hetero atom selected from nitrogen, oxygen, sulfur and phosphorous in the ring. Particularly preferred is when $Q_1$ and $Q_2$ are each an alkyl group, an aryl group or a heterocyclic group, and $R_2$ is an aryl or tertiary alkyl group.

Preferred yellow couplers have the following structures:

Y-1

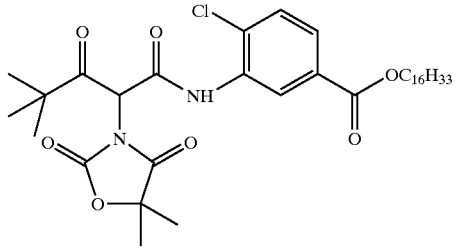

Y-2

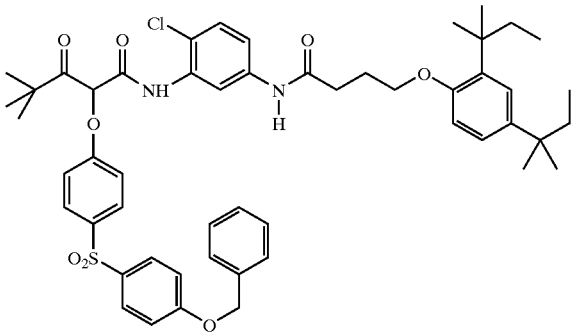

Y-3

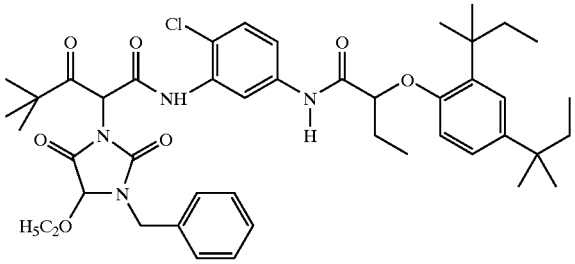

Y-4

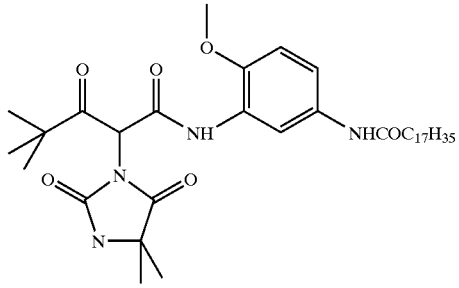

Y-5

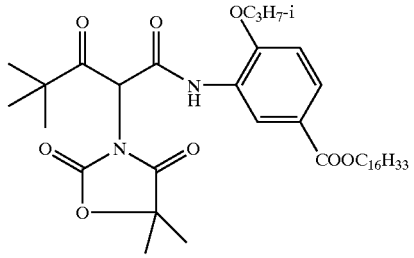

-continued

Y-6

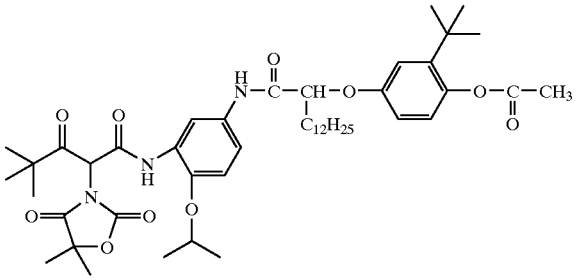

Couplers that form colourless products upon reaction with oxidized colour developing agent are described in such representative patents as: U.K. Patent No. 861,138, U.S. Pat. Nos. 3,632,345, 3,928,041, 3,958,993 and 3,961,959. Typically such couplers are cyclic carbonyl-containing compounds that form colourless products on reaction with an oxidized colour developing agent.

Couplers that form black dyes upon reaction with oxidized colour developing agent are described in such representative patents as U.S. Pat. Nos. 1,939,231, 2,181,944, 2,333,106 and 4,126,461, German OLS No. 2,644,194 and German OLS No. 2,650,764. Typically, such couplers are resorcinols or m-aminophenols that form black or neutral products on reaction with oxidized colour developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343 and 5,234,800.

It may be useful to use additional couplers any of which may contain known ballasts or coupling-off groups such as those described in U.S. Pat. Nos. 4,301,235, 4,853,319 and 4,351,897. The coupler may contain solubilizing groups such as described in U.S. Pat. No. 4,482,629. The coupler may also be used in association with "wrong" coloured couplers (e.g. to adjust levels of interlayer correction) and, in colour negative applications, with masking couplers such as those described in EP-A-0 213 490, Japanese Published Application 58-172,647, U.S. Pat. Nos. 2,983,608, 4,070,191 and 4,273,861, German Applications DE 2,706,117 and DE 2,643,965, UK Patent No. 1,530,272 and Japanese Application 58-113935. The masking couplers may be shifted or blocked, if desired.

The materials for use in the invention may be used in association with materials that accelerate or otherwise modify the processing steps e.g. of bleaching or fixing to improve the quality of the image. Bleach accelerator releasing couplers such as those described in EP-A-0 193 389; EP-A-0 301 477 and in U.S. Pat. Nos. 4,163,669, 4,865,956 and 4,923,784, may be useful. Also contemplated is use of the compositions in association with nucleating agents, development accelerators or their precursors (UK Patent Nos. 2,097,140 and 2,131,188); electron transfer agents (U.S. Pat. Nos. 4,859,578 and 4,912,025); antifogging and anti colour-mixing agents such as derivatives of hydroquinones, aminophenols, amines, gallic acid; catechol; ascorbic acid; hydrazides; sulfonamidophenols and non colour-forming couplers.

The materials for use in the invention may also be used in combination with filter dye layers comprising colloidal silver sol or yellow, cyan and/or magenta filter dyes, either as oil-in-water dispersions, latex dispersions or as solid particle dispersions. Additionally, they may be used with "smearing" couplers (e.g. as described in U.S. Pat. Nos. 4,366,237, 4,420,556, 4,543,323 and in EP-A-0 096 570). Also, the compositions may be blocked or coated in protected form as described, for example, in Japanese Application 61/258,249 or U.S. Pat. No. 5,019,492.

The materials for use in the invention may further be used in combination with image-modifying compounds such as "Developer Inhibitor-Releasing" compounds (DIRs). DIRs useful in conjunction with the compositions of the invention are known in the art and examples are described in U.S. Pat. Nos. 3,137,578, 3,148,022, 3,148,062, 3,227,554, 3,384,657, 3,379,529, 3,615,506, 3,617,291, 3,620,746, 3,701,783, 3,733,201, 4,049,455, 4,095,984, 4,126,459, 4,149,886, 4,150,228, 4,211,562, 4,248,962, 4,259,437, 4,362,878, 4,409,323, 4,477,563, 4,782,012, 4,962,018, 4,500,634, 4,579,816, 4,607,004, 4,618,571, 4,678,739, 4,746,600, 4,746,601, 4,791,049, 4,857,447, 4,865,959, 4,880,342, 4,886,736, 4,937,179, 4,946,767, 4,948,716, 4,952,485, 4,956,269, 4,959,299, 4,966,835, 4,985,336 as well as in patent publications GB 1,560,240, GB 2,007,662, GB 2,032,914, GB 2,099,167, DE 2,842,063, DE 2,937,127, DE 3,636,824, DE 3,644,416 as well as the following European Patent Publications: EP-A-0 272 573, EP-A-0 335 319, EP-A-0 336 411, EP-A-0 346 899, EP-A-0 362 870, EP-A-0 365 252, EP-A-0 365 346, EP-A-0 373 382, EP-A-0 376 212, EP-A-0 377 463, EP-A-0 378 236, EP-A-0 384 670, EP-A-0 396 486, EP-A-0 401 612 and EP-A-0 401 613.

Such compounds are also disclosed in "Developer-Inhibitor-Releasing (DIR) Couplers for Color Photography," C. R. Barr, J. R. Thirtle and P. W. Vittum in Photographic Science and Engineering, Vol.13, p.174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. In a preferred embodiment, the inhibitor moiety or group is selected from the following formulae:

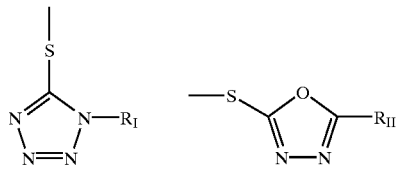

-continued

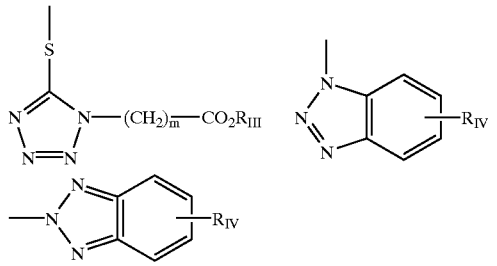

wherein $R_I$ is selected from the group consisting of straight and branched alkyl groups of from 1 to about 8 carbon atoms, benzyl, phenyl and alkoxy groups and such groups containing none, one or more than one such substituent, $R_{II}$ is selected from $R_I$ and —$SR_I$, $R_{III}$ is a straight or branched alkyl group of from 1 to about 5 carbon atoms and m is from 1 to 3, and $R_{IV}$ is selected from the group consisting of hydrogen, halogens and alkoxy, phenyl and carbonamido groups, —$COOR_V$ and —$NHCOO_V$, wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different colour as one associated with a different film layer. It may also be useful that the coupler moiety included in the developer inhibitor-releasing coupler forms colourless products and/or products that wash out of the photographic material during processing (so-called "universal" couplers).

As mentioned, the developer inhibitor-releasing coupler may include a timing group, which produces the time-delayed release of the inhibitor group, such as groups using an intramolecular nucleophilic substitution reaction (U.S. Pat. No. 4,248,962); groups utilizing an electron transfer reaction along a conjugated system (U.S. Pat. Nos. 4,409,323, 4,421,845 and 4,861,701 and Japanese Applications 57-188035; 58-98728; 58-209736; 58-209738); groups utilizing ester hydrolysis (German Patent Application (OLS) No. 2,626,315); groups that function as a coupler or reducing agent after the coupler reaction (U.S. Pat. Nos. 4,438,193 and 4,618,571) and groups that combine the features described above. It is typical that the timing group is of one of the formulae:

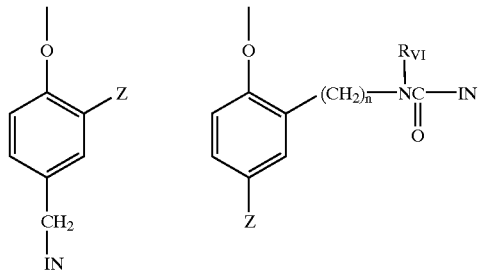

wherein

IN is the inhibitor moiety, Z is selected from the group consisting of nitro, cyano, alkylsulfonyl, sulfamoyl (—$SO_2NR_2$) and sulfonamido (—$NRSO_2R$) groups, n is 0 or 1, and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde or other low molecular weight by-products. The groups are exemplified in EP-A-0 464 612, EP-A-0 523 451, U.S. Pat. No. 4,146,396 and Japanese Kokai 60-249148 and 60-249149.

Suitable developer inhibitor-releasing couplers that may be included in photographic light sensitive emulsion layer include, but are not limited to, the following:

D1

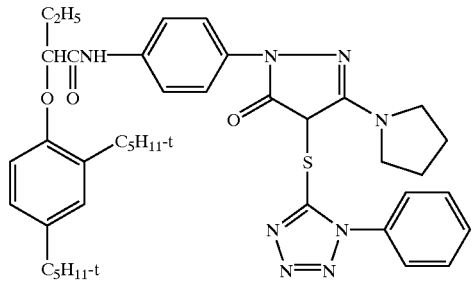

D2

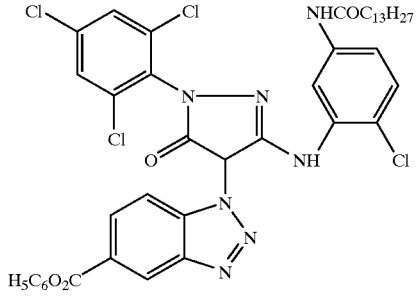

D3

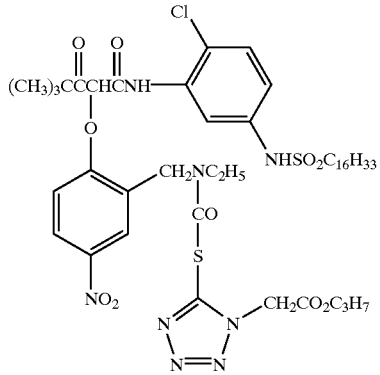

D4

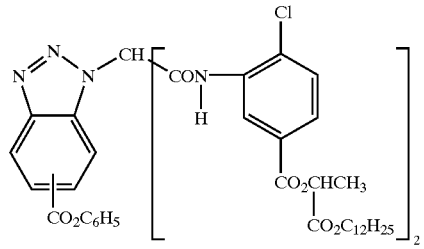

-continued
D5
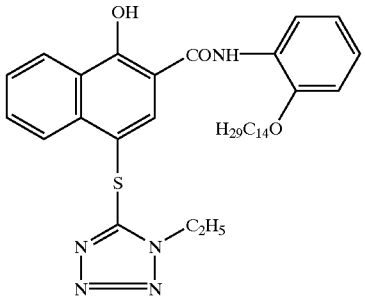
D6
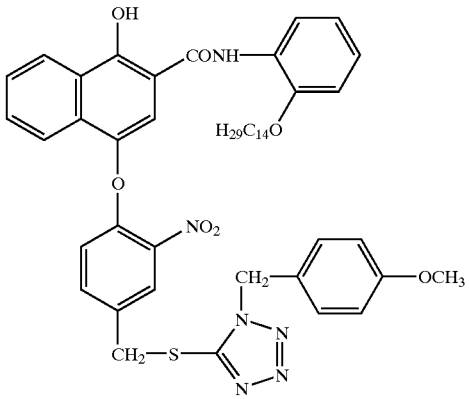
D7
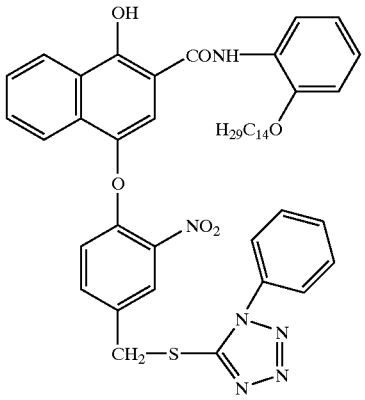
D8
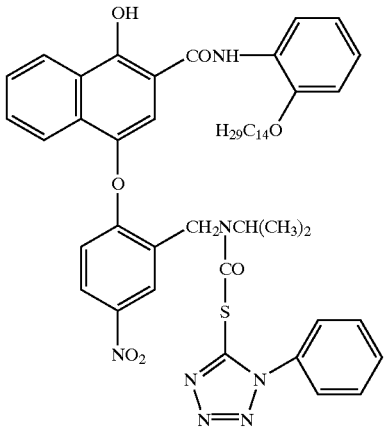
-continued
D9
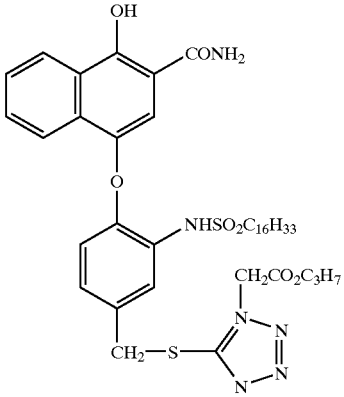
D10
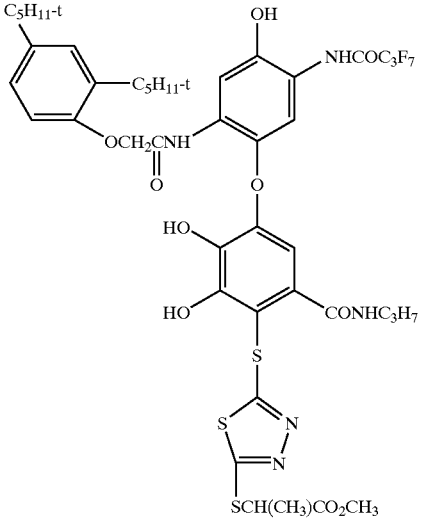
D11
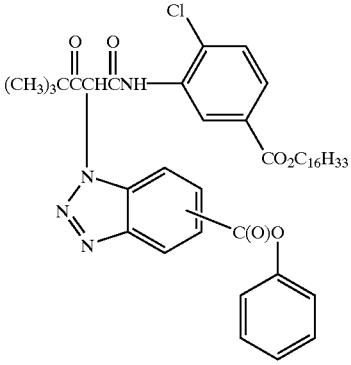
D12
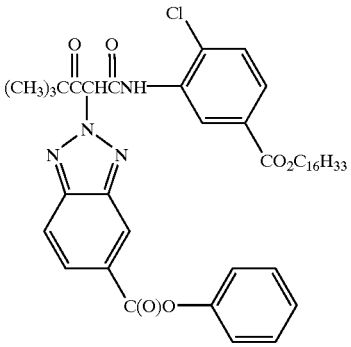

It is also contemplated that the concepts of the present invention may be employed to obtain reflection colour prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994, on a support with reduced oxygen permeability (EP-A-0 553 339), with epoxy solvents (EP-A-0 164 961), with nickel complex stabilizers (U.S. Pat. Nos. 4,346,165, 4,540,653 and 4,906, 559 for example), with ballasted chelating agents such as those in U.S. Pat. No. 4,994,359 to reduce sensitivity to polyvalent cations such as calcium and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630, 90-072,631, 90-072,632, 90-072, 633, 90-072,634, 90-077,822, 90-078,229, 90-078,230, 90-079,336, 90-079,337, 90-079,338, 90-079,690, 90-079, 691, 90-080,487, 90-080,488, 90-080,489, 90-080,490, 90-080,491, 90-080,492, 90-080,494, 90-085,928, 90-086, 669, 90-086,670, 90-087,360, 90-087,361, 90-087,362, 90-087,363, 90-087,364, 90-088,097, 90-093,662, 90-093, 663, 90-093,664, 90-093,665, 90-093,666, 90-093,668, 90-094,055, 90-094,056, 90-103,409, 83-62,586 and 83-09, 959.

Any silver halide combination can be used for the photographic element, such as silver chloride, silver chlorobromide, silver chlorobromoiodide, silver bromide, silver bromoiodide or silver chloroiodide. In cases where the emulsion composition is a mixed halide, the minor component may be added in the crystal formation or after formation as part of the sensitization or melting. The shape of the silver halide emulsion grain can be cubic, pseudo-cubic, octahedral, tetradecahedral or tabular. The emulsions may be precipitated in any suitable environment such as a ripening environment, a reducing environment or an oxidizing environment.

Specific references relating to the preparation of emulsions of differing halide ratios and morphologies are Evans U.S. Pat. No. 3,618,622, Atwell U.S. Pat. No. 4,269,927, Wey U.S. Pat. No. 4,414,306, Maskasky U.S. Pat. No. 4,400,463, Maskasky U.S. Pat. No. 4,713,323, Tufano et al U.S. Pat. No. 4,804,621, Takada et al U.S. Pat. No. 4,738, 398, Nishikawa et al U.S. Pat. No. 4,952,491, Ishiguro et al U.S. Pat. No. 4,493,508, Hasebe et al U.S. Pat. No. 4,820, 624, Maskasky U.S. Pat. No. 5,264,337 and 5,275,930, House et al U.S. Pat. No. 5,320,938 and Chen et al U.S. Pat. No. 5,550,013, Edwards et al U.S. Ser. No. 08/362,283 filed on Dec. 22, 1994 and U.S. Pat. Nos. 5,726,005 and 5,736, 310.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895, Yagi et al U.S. Pat. No. 4,728,603, Sugimoto U.S. Pat. No. 4,755,456, Kishita et al U.S. Pat. No. 4,847,190, Joly et al U.S. Pat. No. 5,017, 468, Wu U.S. Pat. No. 5,166,045, Shibayama et al EP-A-0 328 042 and Kawai EP-A-0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EP-A-0 434 012, Inoue U.S. Pat. No. 5,185,241, Yamashita et al EP-A-0 369 491, Ohashi et al EP-A-0 371 338, Katsumi EP-A-0 435 270 and EP-A-0 435 355 and Shibayama EP-A-0 438 791. Conversely, oxidizing agents may be present during precipitation, used as a pre-treatment of the dispersing medium (gelatin) or added to the emulsion after grain formation before or during sensitization, in order to improve the sensitivity/fog position of the silver halide emulsion or minimize residual ripening agent, as illustrated by Komatsu et al JP 56-167393 and JP 59-195232, Mifune et al EP-A-0 144 990 and EP-A-0 166 347. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et al U.S. Pat. No. 4,035,185 and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive- or (a2) negative-working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", *Photographic Science and Engineering*, Vol. 24, No. 6 November/December 1980, (265–267).

Dopants can be added in conjunction with addenda, antifoggants, dye and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965, Shiba et al U.S. Pat. No. 3,790,390, Habu et al U.S. Pat. No. 4,147,542, Hasebe et al EP-A-0 273 430, Ohshima et al EP-A-0 312 999 and Ogawa U.S. Statutory Invention Registration H760.

Desensitizing, contrast increasing or reciprocity failure reducing ions or complexes are typically dopants which function to trap photogenerated holes or electrons by introducing additional energy levels deep within the bandgap of the host material. Examples include, but are not limited to, simple salts and complexes of Groups 8–10 transition metals (e.g. rhodium, iridium, cobalt, ruthenium, and osmium) and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$ and $K_2Os(NS)Cl_5$. Amine, oxalate, and organic ligand complexes or ions of these or other metals as disclosed in Olm et al U.S. Pat. Nos. 5,360,712 and 5,457,021 and in Kuromoto et al U.S. Pat. No. 5,462,849 are also contemplated. Specific examples include $[IrCl_4(ethylenediamine)_2]^{-1}$, $IrCl_4(CH_3SCH_2CH_2SCH_3)]^{-1}$, $[IrCl_5(pyrazine)]^{-2}$, $[IrCl_5(chloropyrazine)]^{-2}$, $[IrCl_5(N\text{-}methylpyrazinium)]^{-1}$, $[IrCl_5(pyrimidine)]^{-2}$, $[IrCl_5(pyridine)]^{-2}$, $[IrCl_4(pyridine)_2]^{-1}$, $[IrCl_4(oxalate)_2]^{-3}$, $[IrCl_5(thiazole)]^{-2}$, $[IrCl_4(thiazole)_2]^{-1}$, $[IrCl_4(2\text{-}bromothiazole)_2]^{-1}$, $[IrCl_5(5\text{-}methylthiazole)]^{-2}$, $[IrBr_5(thiazole)]^{-2}$ and $[IrBr_4(thiazole)_2]^{-1}$.

In a specific, preferred form it is contemplated to employ as a dopant a hexacoordination complex satisfying the formula: $[ML_6]^n$ where M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$, $Pt^{+4}$; $L_6$ represents six coordination complex ligands which can be independently selected, provided that least four of the ligands are anionic ligands and at least one (preferably at least 3 and optimally at least 4) of the ligands is more electro-negative than any halide ligand and n is −2, −3 or −4.

The following are specific illustrations of dopants capable of providing shallow electron traps:

| | | | |
|---|---|---|---|
| $[Fe(CN)_6]^{-4}$ | SET-1 | $[Ru(CN)_6]^{-4}$ | SET-2 |
| $[Os(CN)_6]^{-4}$ | SET-3 | $[Rh(CN)_6]^{-3}$ | SET-4 |
| $[Ir(CN)_6]^{-3}$ | SET-5 | $[Fe(pyrazine)(CN)_5]^{-4}$ | SET-6 |
| $[RuCl(CN)_5]^{-4}$ | SET-7 | $[OsBr(CN)_5]^{-4}$ | SET-8 |
| $[RhF(CN)_5]^{-3}$ | SET-9 | $[IrBr(CN)_5]^{-3}$ | SET-10 |
| $[FeCO(CN)_5]^{-3}$ | SET-11 | $[RuF_2(CN)_4]^{-4}$ | SET-12 |
| $[OsCl_2(CN)_4]^{-4}$ | SET-13 | $[RhI_2(CN)_4]^{-3}$ | SET-14 |
| $[IrBr_2(CN)_4]^{-3}$ | SET-15 | $[Ru(CN)_5(OCN)]^{-4}$ | SET-16 |
| $[Ru(CN)_5(N_3)]^{-4}$ | SET-17 | $[Os(CN)_5(SCN)]^{-4}$ | SET-18 |
| $[Rh(CN)_5(SeCN)]^{-3}$ | SET-19 | $[Ir(CN)_5(HOH)]^{-2}$ | SET-20 |
| $[Fe(CN)_3Cl_3]^{-3}$ | SET-21 | $[Ru(CO)_2(CN)_4]^{-1}$ | SET-22 |
| $[Os(CN)Cl_5]^{-4}$ | SET-23 | $[Co(CN)_6]^{-3}$ | SET-24 |
| $[Ir(NCS)_6]^{-3}$ | SET-25 | $[In(NCS)_6]^{-3}$ | SET-26 |
| $[Ga(NCS)_6]^{-3}$ | SET-27 | | |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the grains and the silver in epitaxial protrusions. Generally shallow electron trap forming dopants are contemplated to be incorporated in concentrations of at least $1\times10^{-8}$ mol per silver mol up to their solubility limit, typically up to about $10^{-3}$ mol per silver mol. Preferred concentrations are in the range of from about $10^{-6}$ to $10^{-4}$ mol per silver mol. When used in the presence of other deep electron trapping dopants, such as $Cs_2Os(NO)Cl_5$, preferred concentrations of shallow electron traps may approach $10^{-8}$ to $10^{-7}$ mol per silver mol. Combinations of deep and shallow electron trapping dopants may be used to increase contrast as taught by MacIntyre and Bell in U.S. Pat. No. 5,597,686 and by Bell in U.S. Pat. Nos. 5,252,451, 5,256,530, 5,385,817, 5,474,888, 5,480,771 and 5,500,335. It is, of course, possible to distribute the dopant so that a portion of it is incorporated in grains and the remainder is incorporated in the silver halide epitaxial protrusions.

Emulsion addenda that adsorb to grain surfaces, such as antifoggants, stabilizers and dyes can also be added to the emulsions during precipitation. Precipitation in the presence of spectral sensitizing dyes is illustrated by Locker U.S. Pat. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EP-A-0 287 100 and Tadaaki et al EP-A-0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008 and Vandenabeele et al EP-A-0 392 092. Water soluble disulfides are illustrated by Budz et al U.S. Pat. No. 5,418,127.

Chemical sensitization of the materials in this photographic element is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold, or gold only sensitizations are very effective sensitizers. Typical gold sensitizers are chloroaurates, aurous dithiosulfate, aqueous colloidal gold sulfide or aurous bis(1,4,5-trimethyl-1,2,4-triazolium-3-thiolate) tetrafluoroborate (e.g. U.S. Pat. No. 5,049,485). Sulfur sensitizers may include thiosulfate, thiocyanate, N,N'-carbothioyl-bis (N-methylglycine) or 1,3-dicarboxymethyl-1,3-dimethyl-2-thiourea sodium salt.

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfonates, such as tolylthiosulfonate (optionally used with arylsulfinates such as tolylsulfinate) or esters thereof are especially useful (e.g. U.S. Pat. No. 4,960,689). The use of water-soluble disulfides is illustrated in U.S. Pat. No. 5,830,631.

Tabular grain silver halide emulsions may be used in the present invention. Specifically contemplated tabular grain emulsions are those in which greater than 50 percent of the total projected area of the emulsion grains are accounted for by tabular grains having a thickness of less than 0.3 micrometers (0.5 micrometers for blue sensitive emulsion) and an average tabularity (T) of greater than 25 (preferably greater than 100), where the term "tabularity" is employed in its art recognized usage as $$T=ECD/t^2$$

wherein

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky in U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520, 4,414,310, 4,433,048, 4,643,966, 4,647,528, 4,665,012, 4,672,027, 4,678,745, 4,693,964, 4,713,320, 4,722,886, 4,755,456, 4,775,617, 4,797,354, 4,801,522, 4,806,461, 4,835,095, 4,853,322, 4,914,014, 4,962,015, 4,985,350, 5,061,069 and 5,061,616.

The emulsions can be surface-sensitive emulsions, i.e. emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a colour developing agent to reduce developable silver halide and oxidize the colour developing agent. Oxidized colour developing agent in turn reacts with the coupler to yield a dye.

With negative-working silver halide, the processing step described above provides a negative image. The described elements can be processed in the known Kodak C-41™ colour process as described in The British Journal of Photography Annual of 1988, pp 191–198. Where applicable, the element may be processed in accordance with colour print processes such as the RA-4™ process of Eastman Kodak Company as described in the British Journal of Photography Annual of 1988, pp 198–199. Such negative working emulsions are typically sold with instructions to process using a colour negative method such as the C-41™ or RA-4™ process. To provide a positive (or reversal) image, the colour development step can be preceded by development with a non-chromogenic developing agent to develop exposed silver halide, but not form dye, and followed by uniformly fogging the element to render unexposed silver halide developable. Such reversal emulsions are typically sold with instructions to process using a colour reversal process such as E-6™. Alternatively, a direct positive emulsion can be employed to obtain a positive image.

The multicolour photographic elements of the invention may be processed alternatively in a developer solution that will provide reduced processing times of one minute or less (dry to dry), and particularly reduced colour development times of less than about 25 seconds, such that all colour records are fully developed with aim sensitometry.

Preferred colour developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing or bleach-fixing, to remove silver or silver halide, washing and drying.

The coupler dispersions may be coated with emulsions to form photographic elements at very low levels of silver (less than 100 mg/m$^2$). Reasons for doing this include reducing cost, reducing the thickness of silver halide emulsion layers to gain sharpness advantages and reducing the environmental impact during and after processing.

One class of low silver photographic material is colour material intended for redox amplification processes wherein the developed silver acts as a catalyst to the formation of the dye image. This process can take place in a low volume thin processor, such as a low volume thin tank (LVTT), for example, as disclosed in U.S. Pat. No. 5,436,118. Redox amplification processes have been described for example in GB Patent Nos. 1,268,126, 1,399,481, 1,403,418, 1,560,572 and U.S. Pat. Nos. 3,748,138, 3,822,129 and 4,097,278. In such processes, colour materials are developed to produce a silver image (which may contain only small amounts of silver) and are then treated with a redox amplifying solution (or a combined developer-amplifier) to form a dye image.

The invention will now be described with reference to the following examples, which should not, however, be construed as limiting the scope thereof.

EXAMPLES

Preparative Examples

The triazine compounds of formula (I) may be prepared by methods well documented in the chemical and patent literature. Particularly useful are the methods disclosed in Swiss Patent No. 484,695, EP-A-0 165 608, EP-A-0 779 280, EP-A-0 941 989 and U.S. Pat. Nos. 6, 284,821 and 6, 297,378. The schemes in Examples 1 and 2 taken from these references outline general synthetic methods for the preparation of triazine compounds from readily available starting materials, such as cyanuric chloride, resorcinol and m-xylene.

The couplers of formula (IIA) (a), (b) (c) and (d) may be prepared according to the methods described in EP-A-0 744 655, EP-A-0 802 454, EP-A-0 269 436 and U.S. Pat. No. 4,916,051 respectively. The couplers of formula (IIB) (e), (f) and (i) may be prepared as described in U.S. Pat. No. 4,950,585; those of formula (IIB) (g) and (h) according to the syntheses described in EP-A-0 398 664 and JP 04125557 respectively and those of formula (IIB) (j) as disclosed in U.S. Pat. No. 4,970,142.

The stabilizers of formula (III) may be prepared according to the method described hereunder for stabilizer ST-1

Example 1

Synthesis of De-aggregating Compounds of Formula (I)

Scheme A

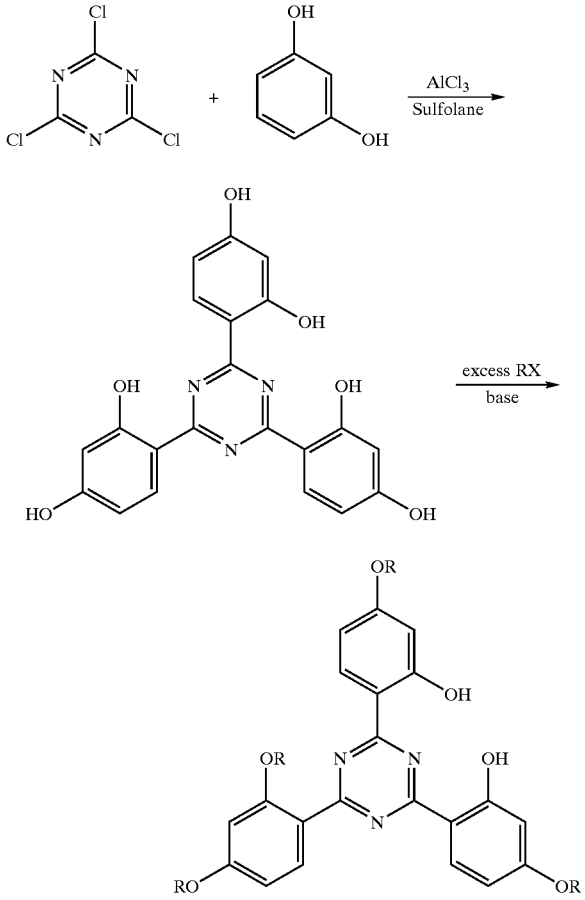

The key intermediate 2,4,6-tris(2,4-dihydroxyphenyl)-1, 3,5-triazine is prepared by the method given in H. Brunetti and C. E. Luthi, Helv.Chim.Acta, 1972, 55, 1566. Resorcinol is reacted with cyanuric chloride in the presence of a Friedel-Crafts catalyst such as aluminium (III) chloride in an aprotic solvent such as sulfolane or nitrobenzene. The tris-hydroxyphenyl triazine intermediate is then alkylated to give a product with the desired number of free 2-hydroxyphenyl substituents on the triazine ring (i.e. in the above example, four of the six available OH groups are alkylated). Suitable alkylating agents are alkyl halides, dialkyl sulfates, alkyl toluenesulfonates or dialkylalkane phosphonates. The reaction is usually carried out in an organic solvent such as 2-methoxyethanol, diglyme or dimethylformamide in the presence of an inorganic base, such as an alkali metal carbonate or hydroxide.

Example 2

Synthesis of De-aggregating Compounds of Formula (I)

Scheme B

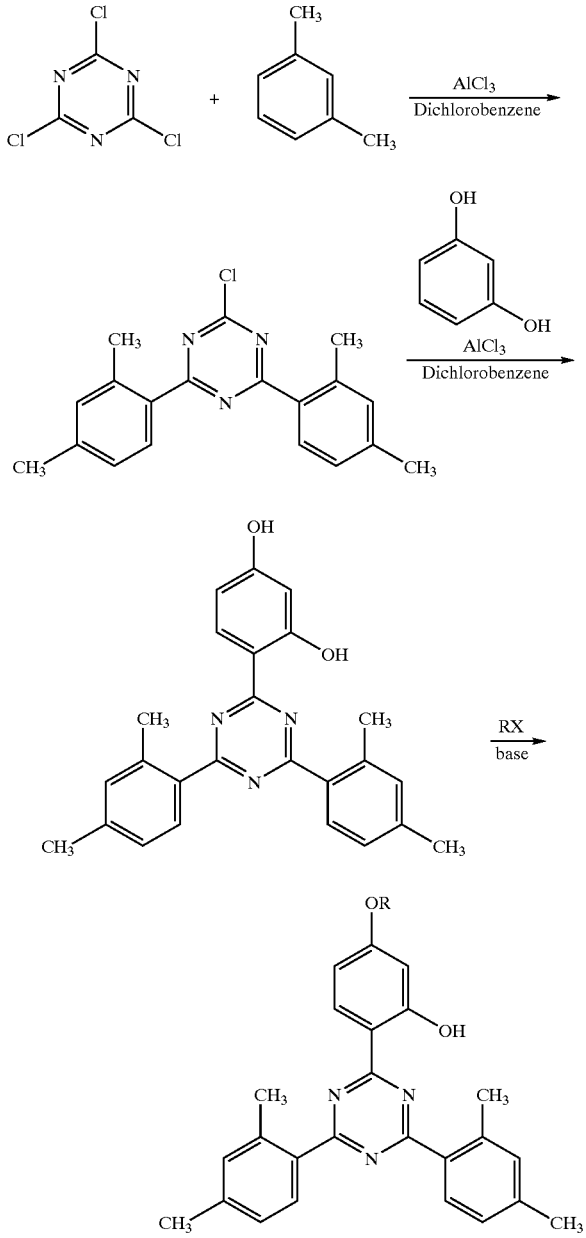

Cyanuric chloride undergoes a Friedel-Crafts reaction with two equivalents of m-xylene in the presence of aluminium(III) chloride in a suitable inert solvent such as dichlorobenzene. The remaining active chlorine atom of the triazine intermediate so obtained is then replaced by resorcinol and the resulting product alkylated in an analogous manner to the compounds described in Scheme A.

Example 3

Synthesis of ST-1

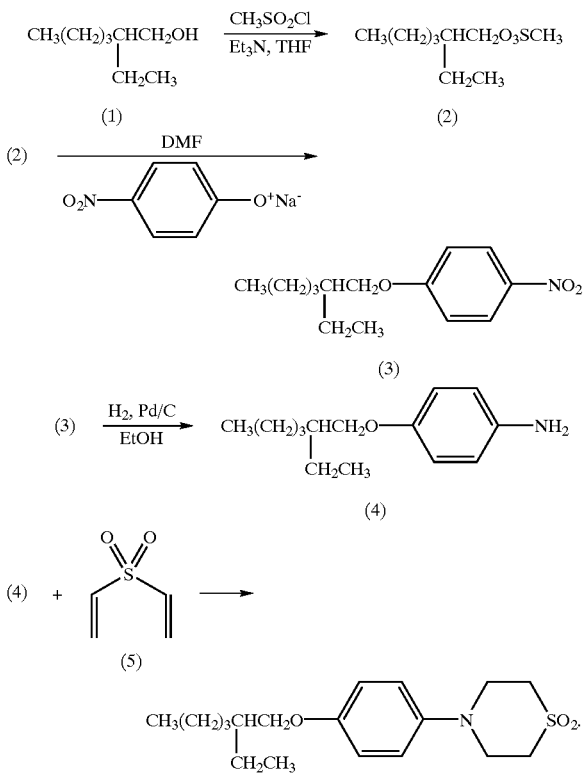

2-ethylhexanol ((1) 236.6 g, 1.82 mol) in 800 ml tetrahydrofuran (THF) was mixed with methanesulfonylchloride (250 g, 2.18 mol). The solution was cooled to 20C in an ice/acetone bath. Triethylamine (220.6 g, 2.18 mol) was then added dropwise maintaining the temperature between 25 and 29C The reaction mixture was then stirred at room temperature overnight. The triethylamine hydrochloride was removed by filtration and the resulting THF solution of the mesylate (2) was concentrated to a pale yellow oil which was used as such for the next step.

A mixture of the sodium salt of p-nitrophenol (39.5 g, 0.2 mol), the mesylate ((2), 54.0 g, 0.2 mol) and dimethylformamide (DMF) (160 ml) was heated for 2 days at 94C. The mixture was then poured into a beaker containing ice and water. The resulting oil was taken up in ether, washed with water and saturated sodium chloride solution, dried over sodium sulfate and concentrated to yield a red/orange oil. The crude product was passed through a plug of silica gel, eluting with dichloromethane. Upon concentration the product was obtained as a pale yellow oil (3). This material (15.0 g, 0.06 mol) was subjected to hydrogenation in a Parr apparatus (ethanol, 200 ml, palladium on charcoal, 1 g). After hydrogen uptake ceased, the solution was filtered and to the filtrate was added divinyl sulfone ((5), 7.7 g, 0.065 mol ). The reaction mixture was heated at reflux overnight and concentrated to get a viscous oil. Upon trituration with hexane, a crystalline solid (ST-1) was obtained which was further purified by recrystallisation from ethanol.

PHOTOGRAPHIC EXAMPLES

Example 4

A typical coupler solution was prepared by heating to 75C mixtures of a coupler of formula (II) and a solvent, added at a 1:1 ratio by weight to which could be added ethyl acetate (at a 3:1 ratio to coupler). Other addenda were also incorporated at this stage at a 1:1 ratio to coupler. Gelatin solutions made from decalcified gelatin in demineralised water and a 10% solution of surfactant Alkanol XC™ were heated at 60C.

In each case the coupler and gelatin solutions were combined and mixed for 3 min. using a Soniprobe (a sonification device manufactured by Lucas Dawe instruments, Great Britain) forming a dispersion consisting of 5% coupler, 8% gelatin and 0.83% surfactant. Each dispersion was diluted to a level appropriate for coating at a coupler laydown of 0.83 mmol/$m^2$.

A light-sensitive photographic multilayer coating was made to the following format shown in TABLE 1 below. The cyan dye-forming dispersions were incorporated in layer 1.

TABLE 1

Structure of Photographic Element

| Layer | Component | Coverage |
|---|---|---|
| Layer 3 | Gelatin | 1.00 g/$m^2$ |
| Layer 2 | Gelatin | 0.60 g/$m^2$ |
| (UV light-absorbing layer) | UV light-absorbing agents: (UV-A:UV-B 0.85:0.15) | 0.24 g/$m^2$ |
| | Stain prevention agent, I | 65.69 mg/$m^2$ |
| | Solvent for UV absorbing agents, F | 79.93 mg/$m^2$ |
| | Hardener, J | 0.11 g/$m^2$ |
| Layer 1 | Gelatin | 1.62 g/$m^2$ |
| (Red-sensitive layer) | Silver chloride emulsion | 0.20 g Ag/$m^2$ |
| | Coupler(s) | 0.83 mmol/$m^2$ |
| Support | Gelatin over polyethylene laminated paper base | 3.00 g/$m^2$ |

Other materials which were used in the comparative dispersions in the preparation of the photographic element are shown below.

UV absorber A

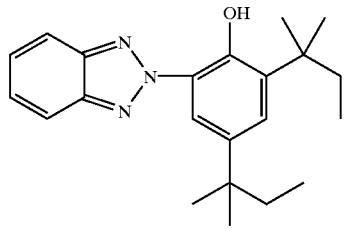

UV absorber B

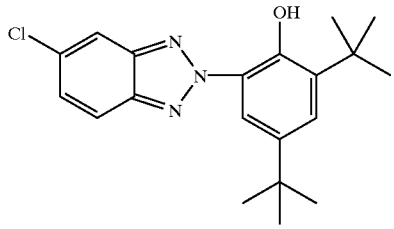

-continued

Compound C

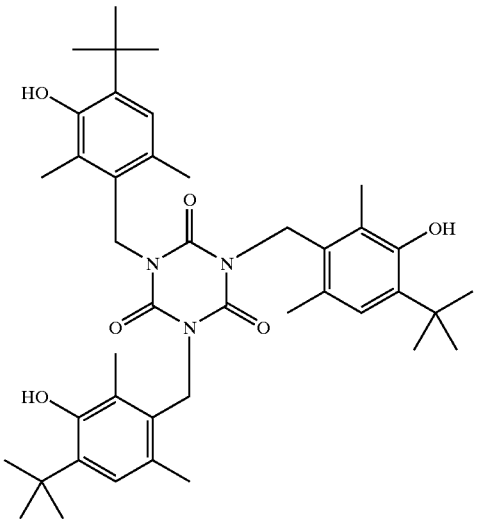

Solvent D

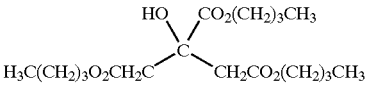

Solvent E

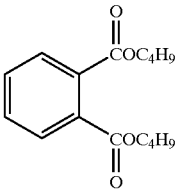

Solvent F

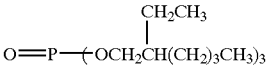

Solvent G

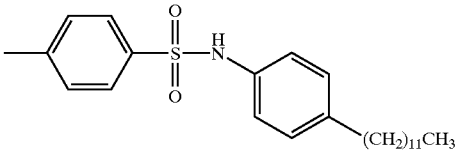

Compound H

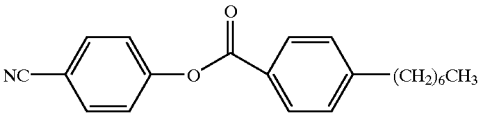

Stain prevention agent I

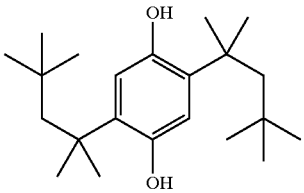

Hardener J

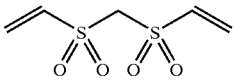

-continued

Compound K

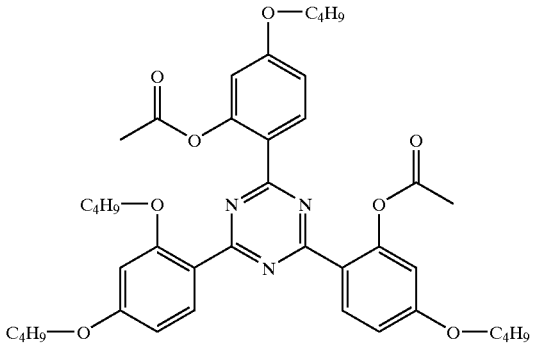

Processed samples were prepared by exposing the coatings through a step tablet (density range 0–3, 0.15 inc.) and developed for 0.1 s and processed through a Kodak Process RA-4™ as follows.

| Process Step | Time (min.) | Temp. (C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts/liter solution):

| | |
|---|---|
| **Developer** | |
| Triethanolamine | 12.41 g |
| Blankophor REU ™ | 2.30 g |
| Lithium polystyrene sulfonate | 0.09 g |
| N,N-Diethylhydroxylamine | 4.59 g |
| Lithium sulfate | 2.70 g |
| Developing agent, Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7° C. | |

Dev-1

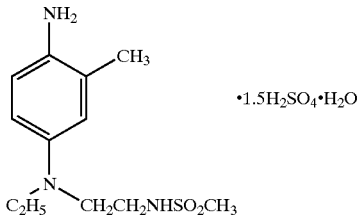

The reflectance spectra of the image dyes of the exposed and processed samples were measured and normalised to a maximum absorption of 1.00. From these spectra the following parameters were recorded: the wavelength at maximum absorption, $\lambda_{max}$; the half-bandwidth of each spectrum, HBW; the wavelength at the midpoint position of the half-bandwidth, $\lambda_{mid}$; and unwanted green absorption in the normalised spectrum of each cyan dye, i.e. the density at 530 nm ($D_{530}$). A lower value indicated less unwanted green absorption, which was preferable. A narrower half-bandwidth combined with a higher value for $\lambda_{mid}$ indicated less aggregation in the dye. The spectral values for each coupler are shown in the Tables below.

The light stability of the image dyes was tested by exposing the processed strips to the light from a Xenon arc lamp at an intensity of 50 klux for two weeks. The amount of fade from the initial density of 1.00 is reported as a percentage under the column heading "Light fade" in TABLE 2—a lower number being better.

TABLE 2

| Element | Compound (I) | Coupler (II) | Stabilizer (III) | Solvent | λmax (nm) | λmid (nm) | HBW (nm) | $D_{530}$ (nm) | % Light Fade | Comment |
|---|---|---|---|---|---|---|---|---|---|---|
| 101 | — | C-1 | — | D | 653.4 | 630.2 | 123.5 | 0.21 | 98 | Comp. |
| 102 | — | " | — | G | 656.7 | 635.8 | 112.1 | 0.17 | 84 | Comp. |
| 103 | — | " | ST-1 | D | 649.4 | 627.5 | 118.7 | 0.22 | 45 | Comp. |
| 104 | — | " | ST-4 | " | 648.2 | 626.2 | 128.5 | 0.25 | 39 | Comp. |
| 105 | I-1 | " | — | " | 651.8 | 630.9 | 103.3 | 0.16 | 84 | Comp. |
| 106 | C | " | — | " | 648.8 | 626.6 | 120.9 | 0.23 | 100 | Comp. |
| 107 | I-1 + C | " | — | " | 649.7 | 630.8 | 104.0 | 0.17 | 96 | Comp. |
| 108 | I-2 | " | — | " | 650.2 | 629.0 | 109.8 | 0.19 | 81 | Comp. |
| 109 | H | " | ST-4 | " | 647.7 | 626.4 | 116.7 | 0.21 | 61 | Comp. |
| 110 | I-1 | " | ST-1 | " | 649.3 | 630.8 | 105.6 | 0.17 | 15 | Inv. |
| 111 | " | " | ST-4 | " | 648.8 | 629.7 | 108.4 | 0.18 | 14 | Inv. |
| 112 | I-2 | " | ST-1 | " | 647.5 | 628.9 | 109.5 | 0.19 | 16 | Inv. |
| 113 | I-1 | " | ST-4 | G | 653.8 | 635.3 | 99.1 | 0.13 | 10 | Inv. |
| 114 | I-2 | " | " | D | 647.0 | 627.7 | 114.5 | 0.20 | 18 | Inv. |

The data in TABLE 2 show clearly that it is the combination of de-aggregating compound with stabilizer which provides the desired improvement in dye hue as well as the dramatic improvement in dye stability. The triazinetrione material (comparative compound C) does not improve light quality is improved with the latter. Element 109 uses a liquid crystalline material, H, as a de-aggregating agent. It was reported in EP-A-0 886 179 that liquid crystalline solvents, such as H, could be used to improve colour reproducibility for a variety of heterocyclic coupler classes, including pyrazolo-based couplers. It can be seen from the data that, when combined with ST-4, H provides a dye hue with a narrower halfbandwidth than the comparison formulation in Element 101, although the effect on unwanted green absorption (as measured by $D_{530}$) is negligible. However, although there is an improvement in light stability when compared with element 101, this improvement is small when compared with the results from formulations of the invention which incorporate de-aggregating compounds of formula (I) with a stabilizer of formula (III).

Example 5

In this example, samples containing other couplers of structure similar to that in Example 4 were incorporated into dispersions and coated as shown in Example 4. Examples of other well-known dye stabilizers were also used for comparison with those used in the invention. The data are shown in TABLE 3.

TABLE 3

| Element | Compound (I) | Coupler (II) | Stabilizer (III) | Solvent | λmax (nm) | λmid (nm) | HBW (nm) | $D_{530}$ (nm) | % Light Fade | Comment |
|---|---|---|---|---|---|---|---|---|---|---|
| 115 | — | C-4 | — | D | 644.7 | 622.6 | 128.1 | 0.26 | 97 | Comp. |
| 116 | — | " | ST-1 | " | 643.0 | 625.1 | 118.3 | 0.23 | 99 | Comp. |
| 117 | — | " | ST-4 | " | 640.5 | 620.5 | 138.0 | 0.30 | 100 | Comp. |
| 118 | I-1 | " | ST-1 | " | 645.3 | 627.4 | 107.4 | 0.18 | 64 | Inv. |
| 119 | I-1 | " | ST-4 | " | 646.1 | 626.6 | 110.7 | 0.19 | 56 | Inv. |
| 120 | — | C-5 | — | E | 577.5 | 598.3 | 138.9 | 0.52 | 95 | Comp. |
| 121 | — | " | ST-1 | " | 586.2 | 601.9 | 138.4 | 0.47 | 25 | Comp. |
| 122 | I-1 | " | ST-1 | " | 640.7 | 613.3 | 125.5 | 0.32 | 13 | Inv. |
| 123 | — | C-8 | — | D | 596.4 | 615.3 | 141.1 | 0.35 | 80 | Comp. |
| 124 | — | " | ST-1 | " | 646.2 | 617.0 | 135.2 | 0.32 | 43 | Comp. |
| 125 | — | " | ST-4 | " | 598.6 | 616.3 | 139.3 | 0.34 | 41 | Comp. |
| 126 | I-1 | " | — | " | 648.6 | 625.0 | 112.3 | 0.21 | 81 | Comp. |
| 127 | I-2 | " | — | " | 646.0 | 621.7 | 121.1 | 0.24 | 66 | Comp. |
| 128 | " | " | ST-1 | " | 645.5 | 621.1 | 118.4 | 0.24 | 21 | Inv. |
| 129 | " | " | ST-4 | " | 644.3 | 618.3 | 133.3 | 0.30 | 24 | Inv. |
| 130 | I-1 | " | ST-1 | " | 648.2 | 625.5 | 108.7 | 0.19 | 14 | Inv. |
| 131 | " | " | ST-4 | " | 647.2 | 623.5 | 113.8 | 0.22 | 14 | Inv. |

TABLE 3-continued

| Element | Compound (I) | Coupler (II) | Stabilizer (III) | Solvent | λmax (nm) | λmid (nm) | HBW (nm) | $D_{530}$ (nm) | % Light Fade | Comment |
|---|---|---|---|---|---|---|---|---|---|---|
| 132 | — | C-2 | — | D | 656.7 | 630.9 | 130.1 | 0.23 | 97 | Comp. |
| 133 | — | " | ST-1 | " | 649.6 | 626.6 | 123.7 | 0.24 | 56 | Comp. |
| 134 | I-1 | " | — | " | 654.1 | 634.7 | 111.4 | 0.17 | 80 | Comp. |
| 135 | " | " | ST-1 | " | 650.8 | 630.5 | 107.0 | 0.17 | 9 | Inv. |
| 136 | — | C-9 | — | D | 629.9 | 610.7 | 96.4 | 0.24 | 100 | Comp. |
| 137 | — | " | ST-1 | " | 630.4 | 612.1 | 95.3 | 0.22 | 71 | Comp. |
| 138 | I-2 | " | ST-1 | " | 631.9 | 613.7 | 90.7 | 0.20 | 53 | Inv. |
| 139 | — | C-13 | — | D | 647.3 | 611.9 | 162.2 | 0.49 | 62 | Comp. |
| 140 | — | " | — | G | 651.7 | 628.9 | 120.4 | 0.22 | 85 | Comp. |
| 141 | I-1 | " | — | D | 647.3 | 626.6 | 111.5 | 0.21 | 74 | Comp. |
| 142 | " | " | ST-3 | " | 648.8 | 628.0 | 107.7 | 0.19 | 41 | Inv. |
| 143 | " | " | ST-1 | " | 645.5 | 625.4 | 109.7 | 0.21 | 9 | Inv. |
| 144 | " | " | " | G | 649.3 | 630.6 | 105.4 | 0.17 | 8 | Inv. |

The data show that a combination of triazine compounds with the stabilizers used in the invention provide good dye stability with less unwanted green absorption.

The FIGURE shows the spectra obtained from the dyes generated in exposed and processed monochrome coatings of coupler C-8 in solvent D with (or without) certain addenda. The thick solid line representing the spectrum from the coupler in solvent alone, i.e. with no additional addenda, displays a main absorption band due to aggregated dye. The dye from this coupler is highly aggregated. The thin solid line represents the spectrum from the coupler with stabilizer ST-4 of formula (III), which has very little effect on de-aggregation. The thin solid line with + signs, representing the spectrum from the coupler with stabilizer ST-1 of formula (III), shows a small improvement in de-aggregation in the dye. The thin dashed line represents the spectrum from the coupler with stabilizer ST-4 of formula (III) and of de-aggregating compound I-1 of formula (I) and illustrates the large effect this combination has on de-aggregation of the dye. The thin dashed-dotted line represents the spectrum from the coupler with stabilizer ST-1 of formula (III) and compound I-1 of formula (I), which again shows a large de-aggregation effect.

Thus the FIGURE shows the large reduction in unwanted absorptions obtained when compounds of formula (I) are used in combination with stabilizers of formula (III) to de-aggregate dyes and also illustrates that, on their own, the stabilizers of formula (III) have little if any effect on de-aggregation of the dye.

Example 6

This study was extended to 2-equivalent cyan pyrazolotriazoles to observe the effects of the combination of compounds of this invention. The elements in Example 6 were made up as for Example 4 but were coated with a red-sensitized emulsion at 0.10 g/m$^2$. The data are shown in TABLE 4.

TABLE 4

| Element | Compound (I) | Coupler (II) | Stabilizer (III) | Solvent | λmax (nm) | λmid (nm) | HBW (nm) | $D_{530}$ (nm) | % Light Fade | Comment |
|---|---|---|---|---|---|---|---|---|---|---|
| 145 | — | C-11 | — | D | 576.2 | 577.0 | 58.6 | 0.26 | 62 | Comp. |
| 146 | I-1 | " | — | " | 650.6 | 616.9 | 133.6 | 0.27 | 57 | Comp. |
| 147 | I-1 | " | ST-1 | " | 648.6 | 622.3 | 121.0 | 0.21 | 16 | Inv. |
| 148 | — | C-10 | — | " | 650.8 | 626.2 | 133.8 | 0.25 | 100 | Comp. |
| 149 | — | " | ST-1 | " | 649.3 | 629.5 | 117.0 | 0.21 | 89 | Comp. |
| 150 | I-1 | " | — | " | 651.9 | 632.4 | 108.9 | 0.17 | 66 | Comp. |
| 151 | " | " | ST-1 | " | 649.3 | 631.0 | 104.7 | 0.17 | 16 | Inv. |
| 152 | — | C-18 | — | G | 653.9 | 627.6 | 125.5 | 0.36 | 99 | Comp. |
| 153 | K | " | ST-1 | " | 650.0 | 631.2 | 104.5 | 0.27 | 89 | Comp. |
| 154 | I-1 | " | " | " | 652.0 | 632.8 | 100.3 | 0.25 | 16 | Inv. |

Once again, the data show that a combination of triazine compounds with the stabilizers used in the invention provide good dye stability with less unwanted green absorption. Element 153 shows the data from a coating of a combination of stabilizer with compound K, which is similar to the de-aggregating compounds used in the invention but does not provide significant additional light stability when compared with element 154.

Example 7

This study was extended to cyan pyrazolobenzimidazoles, such as C-46, to observe the effects of the combination of compounds of this invention on the dyes produced by this class of couplers. The elements in Example 7 were made up as for Example 4. These couplers are very crystalline and it is difficult to prevent them from crystallizing from the dispersion. Hence the dispersions can be fairly inactive, so a good measure of dispersion stability is the level of red $D_{max}$ formed after processing. Dye hue data is presented as described in Example 4, and shown below in TABLE 5.

The light stability of the image dyes was tested by exposing the processed strips to the light from a Xenon arc lamp at an intensity of 50 klux for two weeks. The amount of fade from the initial density of 0.5 is reported as a percentage under the column heading "Light fade" in TABLE 5—as before, a lower number is better.

From TABLE 5 below, once again, the data show that a combination of triazine compounds with the stabilizers used in the invention provide good dye stability with less unwanted green absorption.

The entire contents of the patents and other publications referred to in this specification are incorporated herein by reference.

The invention has been described in detail with particular reference to certain preferred embodiments thereof, but it will be understood that variations and modifications can be effected within the spirit and scope of the invention.

TABLE 5

| Element | Compound (I) | Coupler (II) | Stabilizer (III) | Solvent | λmax (nm) | λmid (nm) | HBW (nm) | $D_{530}$ (nm) | Red $D_{max}$ | % Light Fade | Comment |
|---|---|---|---|---|---|---|---|---|---|---|---|
| 155 | — | C-46 | — | D | 596.8 | 564.4 | 295.2 | 0.61 | 0.76 | 36 | Comp. |
| 156 | I-1 | " | ST-1 | " | 650.9 | 620.7 | 125.6 | 0.27 | 2.29 | 27 | Inv. |

What we claim is:

1. A photographic element comprising at least one light-sensitive silver halide emulsion layer having associated therewith in the same dispersion a de-aggregating compound of formula (I), at least one heterocyclic cyan dye-forming coupler of formula (II) and a stabilizer of formula (III):

wherein the de-aggregating compound has the formula (I)

(I)

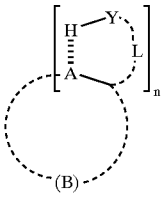

wherein

A is a hydrogen-bond-accepting hetero-atom or -group;

Y is a hydrogen-bond-donating hetero-atom or -group;

L is a linking group that is partially or wholly conjugated with A and linked to A by a carbon atom;

n is 1, 2 or 3 hydrogen-bond-containing moieties; and (B) comprises the remaining atoms for completion of an unsubstituted or substituted heterocyclic ring or ring system containing the hydrogen bond-accepting hetero-atom or -group, which may contain one or more other heteroatoms selected from nitrogen, oxygen and sulfur; and wherein the heterocyclic cyan dye-forming coupler has the formula (II):

(II)

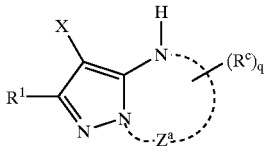

wherein $R^1$ is hydrogen or a substituent;

$R^c$ is a substituent; and q is 0 to 4;

$Z^a$ represents the atoms necessary to complete an unsubstituted or substituted 5- to 10-membered heterocyclic ring system which may contain one or more other heteroatoms selected from nitrogen, oxygen and sulfur;

providing that each $R^c$ is attached to a carbon atom of the ring; and

X is selected from hydrogen or halogen or a group which is separable by the reaction of coupler with an oxidized colour developing agent; and wherein the stabilizer of formula (III) has the formula (III)

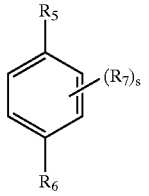

wherein $R_5$ is an electron-donating group;

$R_6$ is a substituent;

each $R_7$ is an independently selected substituent; or one of $R_5$ and $R_6$ may join with $R_7$ to form an unsubstituted or substituted 5- to 10-membered ring system which may contain one or more heteroatoms selected from nitrogen, oxygen and sulfur; and s is 0 to 4;

provided that (a) when one of $R_5$ and $R_6$ is a hydroxy group then the other may not be an arylsulfonamido or arylsulfamoyl substituent, and (b) at least one of $R_5$, $R_6$ and $R_7$ contains a ballast group comprising at least 8 carbon atoms.

2. An element as claimed in claim 1 wherein A is a carbonyl, iminyl, sulfonyl, sulfinyl group or a nitrogen atom.

3. An element as claimed in claim 1 wherein L is a sulfonyl, sulfinyl or carbonyl group or one or more alkenyl groups which can complete an unsubstituted or substituted 5- to 10-membered ring system, which may contain one or more other heteroatoms selected from nitrogen, oxygen and sulfur.

4. An element as claimed in claim 1 wherein Y is an atom or group that can provide intramolecular hydrogen-bonding with A selected from —O—, —NR, —NCOR, —NCONHR or —$NSO_2R$, wherein R is an unsubstituted or substituted alkyl or aryl group, or —N—, wherein the nitrogen atom forms with L part of a 5- to 10-membered heterocyclic ring system.

5. An element as claimed in claim 1 wherein the de-aggregating compound has the formula (IA):

(IA)

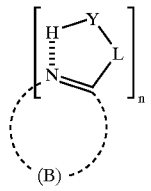

wherein

N is an aza nitrogen;

L is selected from the class consisting of a sulfonyl, sulfinyl and carbonyl group and one or more alkenyl groups which form part of an unsubstituted or substituted 5- to 10-membered ring system, which may contain one or more other heteroatoms selected from nitrogen, oxygen and sulfur;

(B) comprises the remaining atoms for completion of an unsubstituted or substituted 5- to 10-membered heterocyclic ring or ring system containing the hydrogen-bond-accepting hetero-atom or -group, which may contain one or more other heteroatoms selected from nitrogen, oxygen and sulfur;

Y is a hydrogen-bond-donating hetero-atom or -group; and n is 1, 2 or 3 hydrogen-bond-containing moieties.

6. An element as claimed in claim 5 wherein (B) with N═ completes the atoms of a 5-, 6- or 7-membered heterocyclic ring.

7. An element as claimed in claim 1 wherein the de-aggregating compound has the formula (IB):

(IB)

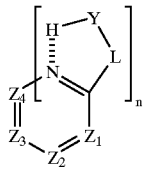

wherein $Z_1$ to $Z_4$ are independently nitrogen atoms or unsubstituted or substituted carbon atoms, one or two adjacent pairs of which may each support an additional hydrogen-bond-containing moiety, each moiety being the same or different, such that n is 1, 2 or 3;

provided that at least one of $Z_1$ to $Z_4$ is an unsubstituted or substituted carbon atom;

L comprises one or more alkenyl groups which form part of an unsubstituted or substituted 5–10-membered ring system, which may contain one or more other heteroatoms selected from nitrogen, oxygen and sulfur; and Y is a hydrogen-bond-donating hetero-atom or -group.

8. An element as claimed in claim 1 wherein the de-aggregating compound has the formula (IC):

(IC)

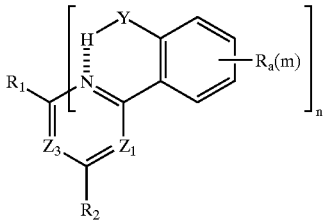

wherein $R_1$ and $R_2$ are independently hydrogen or a substituent;

each $R_a$ is an independently selected substituent;

m is 0 to 4; and $Z_1$ and $Z_3$ are independently nitrogen atoms or unsubstituted or substituted carbon atoms each of which together with an adjacent substituted carbon atom may support an additional hydrogen-bond-containing moiety, each moiety being the same or different, such that n is 1, 2 or 3; and Y is a hydrogen-bond-donating hetero-atom or -group.

9. An element as claimed in claim 7 wherein each Y is —O— and $Z_1$ and $Z_3$ are both nitrogen atoms.

10. An element as claimed in claim 7 wherein n is 1 or 2.

11. An element as claimed in claim 1 wherein the de-aggregating compound has the formula (ID) or (IE):

(ID)

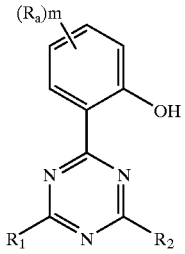

(IE)

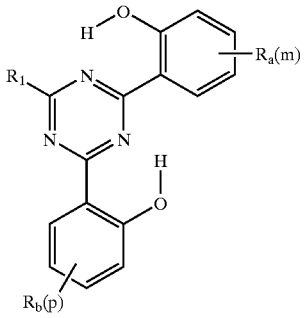

wherein $R_1$ and $R_2$ are independently hydrogen or a substituent;

each Ra and each $R_b$ is an independently selected substituent; and m and p are independently 0 to 4.

12. An element as claimed in claim 8 wherein substituents for $R_1$, $R_2$, each $R_a$ and each $R_b$ are independently selected from cyano, fluoro, chloro, bromo, iodo; or an unsubstituted or substituted alkyl, aryl, heterocyclyl, alkoxy, aryloxy, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, alkyl- or aryl-thio, alkyl- or aryl-phosphonate, nitro, alkyl- or aryl-amino, alkyl- or aryl-ureido or alkyl- or aryl-carbamoyl group, any of which may be further substituted, or any of $R_1$, $R_2$ and one or more $R_a$ may join to form a dimer or polymer.

13. An element as claimed in claim 12 wherein each $R_a$ is independently an unsubstituted or substituted alkyl, alkoxy, alkoxycarbonyl or alkylcarbamoyl group.

14. An element as claimed in claim 12 wherein one of $R_1$ and $R_2$ is a phenyl group, substituted with one or more halogen or alkoxy, alkyl, alkylsulfonamido or alkylsulfonyl groups.

15. An element as claimed in claim 8 wherein each m is 1 and meta to Y.

16. An element as claimed in claim 1 wherein the compound of formula (II) has the formula (IIA):

(IIA)

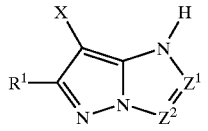

wherein $Z^1$ and $Z^2$ are independently —CH— groups, which may together form part of an unsubstituted or substituted phenyl ring, —CR— groups, wherein R is a substituent, or nitrogen atoms; and $R^1$ is hydrogen or a substituent; and X is selected from hydrogen or halogen or a group which is separable by the reaction of coupler with an oxidized colour developing agent.

17. An element according to claim 16 wherein the compound of formula (IIA) has one of the structures:

(a)

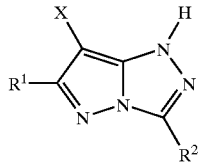

(b)

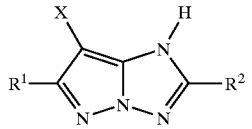

(c)

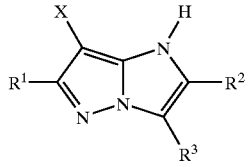

(d)

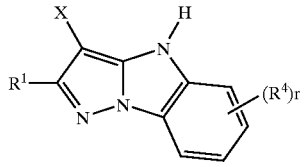

wherein each of $R^1$ to $R^4$ is hydrogen or an independently selected substituent;

r is 0 to 4; and

X is selected from hydrogen or halogen or a group which is separable by the reaction of coupler with an oxidized colour developing agent.

18. An element as claimed in claim 1 wherein the compound of formula (II) has the structure (IIB):

(IIB)

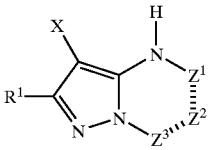

wherein one of $Z^1$ and $Z^3$ is a carbonyl or sulfonyl group and the other is a —CH— or —CR— group, wherein R is a substituent, or a nitrogen atom;

$Z^2$ is a —CH— or —CR— group or a nitrogen atom; or $Z^2$ and the other of $Z^1$ and $Z^3$ may together form an unsubstituted or substituted aryl ring or a 5- to 10-membered heterocyclic ring which may contain one or more heteroatoms selected from nitrogen, oxygen and sulfur, which ring is unsubstituted or substituted;

$R^1$ is hydrogen or a substituent; and

X is selected from hydrogen or halogen or a group which is separable by the reaction of coupler with an oxidized colour developing agent.

19. An element as claimed in claim 18 wherein the compound of formula (IIB) has one of the structures:

(e)

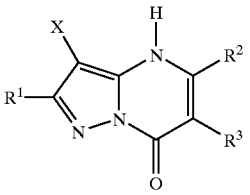

(f)

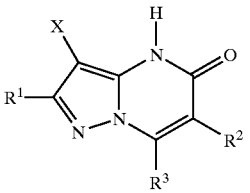

(g)

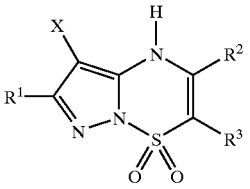

(h)

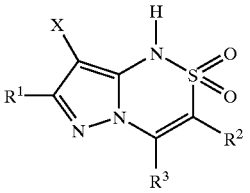

-continued (i)

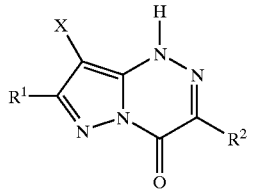

(j)

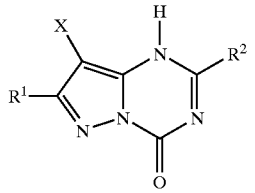

wherein each of $R^1$ to $R^3$ is hydrogen or an independently selected substituent or $R^2$ and $R^3$ may join to form an unsubstituted or substituted aryl ring or a 5- to 10-membered heterocyclic ring which contains one or more heteroatoms selected from nitrogen, oxygen and sulfur, which ring is unsubstituted or substituted; and X is selected from hydrogen or halogen or a group which is separable by the reaction of coupler with an oxidized colour developing agent.

20. An element as claimed in claim 1 wherein the substituents for $R^1$, $R^2$, $R^3$ and $R^4$ may be independently selected from cyano, fluoro, chloro, bromo, iodo; or an unsubstituted or substituted alkyl, aryl, heterocyclyl, alkoxy, aryloxy, alkyl- or aryl-carbonyl, alkyl- or aryl-oxycarbonyl, acyloxy, carbonamido, alkyl- or aryl-carbonamido, alkyl- or aryl-oxycarbonyl-amino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, alkyl- or aryl-thio, alkyl- or aryl-phosphonate, nitro, alkyl- or aryl-amino, alkyl- or aryl-ureido or alkyl- or aryl-carbamoyl group, any of which may be further substituted.

21. An element as claimed in claim 20 wherein $R^1$ is an alkyl- or aryl-carbonamido or an alkyl- or aryl-carbamoyl group substituted with an alkyl, alkoxy, aryl, or an aryloxy group, any of which may be further substituted.

22. An element as claimed in claim 17 wherein one of $R^2$ and $R^3$ is a phenyl group substituted with one or more halogen, alkyl, alkoxycarbonyl, alkylsulfamoyl, alkyl- or aryl-sulfonamido, alkylcarbonamido or alkylsulfonyl groups, any of which may be further substituted.

23. An element as claimed in claim 17 wherein $R^2$ and $R^3$ join to form an unsubstituted or substituted phenyl ring.

24. An element as claimed in claim 1 wherein in formula (III) $R_5$ and $R_6$ are independently selected from a hydroxy or an unsubstituted or substituted alkyl, aryl, alkoxy, aryloxy, alkyl- or aryl-oxycarbonyl, alkyl- or aryl-oxycarbonylamino, alkoxycarbonyloxy, mono- and di-alkylamino, (including pyrrolidino, morpholino, and thiomorpholine dioxide), arylamino, alkyl- or aryl-ureido, alkyl- or aryl-sulfonyloxy, alkyl- or aryl-oxysulfonyl, alkyl- or aryl-thio, alkyl- or aryl-sulfamoylamino or an alkyl- or aryl-sulfonamido group, any of which may be further substituted, or $R_6$ may be O-phosphonate, O-silyl or an electron-withdrawing group.

25. An element as claimed in claim 1 wherein in formula (III) at least one of $R_5$ and $R_6$ is an alkoxy group, substituted with an alkoxycarbonyl group, a dialkylamino group (including a thiomorpholine dioxide group) or an unsubstituted or substituted alkyl or alkylsulfonamido group.

26. An element as claimed in claim 1 wherein in formula (III) $R_7$, when present, is independently a cyano, fluoro, chloro, bromo, iodo; or an unsubstituted or substituted alkyl, aryl, heterocyclyl, alkoxy, aryloxy, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, alkyl- or aryl-thio, alkyl- or aryl-phosphonate, nitro, alkyl- or aryl-amino, alkyl- or aryl-ureido or alkyl- or aryl-carbamoyl group, any of which may be further substituted.

27. An element as claimed in claim 1 wherein in formula (III) s is 0, 1 or 2.

28. An element as claimed in claim 1 wherein the laydown of total coupler is from about 0.05 mmol/$m^2$ to about 1.5 mmol/$m^2$.

29. An element as claimed in claim 1 wherein the molar ratio of de-aggregating compound of formula (I) to total coupler of formula (II) is from about 0.01:1 to about 4:1.

30. An element as claimed in claim 1 wherein the ratio of solvent to total coupler (by weight) is from about 0.2:1 to about 5:1.

31. An element as claimed in claim 1 wherein the ratio of stabilizer to total coupler (by weight) is from about 0.1:1 to about 4:1.

32. A multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element comprises at least one light-sensitive silver halide emulsion layer having associated therewith in the same dispersion a de-aggregating compound of formula (I), at least one heterocyclic cyan dye-forming coupler of formula (II) and a stabilizer of formula (III):

wherein the de-aggregating compound has the formula (I)

(I)

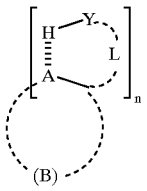

wherein

A is a hydrogen-bond-accepting hetero-atom or -group;

Y is a hydrogen-bond-donating hetero-atom or -group;

L is a linking group that is partially or wholly conjugated with A and linked to A by a carbon atom;

n is 1, 2 or 3 hydrogen-bond-containing moieties; and (B) comprises the remaining atoms for completion of an unsubstituted or substituted heterocyclic ring or ring system containing the hydrogen bond-accepting hetero-atom or -group, which may contain one or more other heteroatoms selected from nitrogen, oxygen and sulfur; and wherein the heterocyclic cyan dye-forming coupler has the formula (II):

(II)

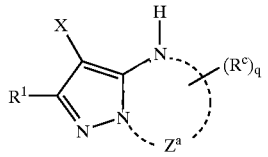

wherein $R^1$ is hydrogen or a substituent;

$R^c$ is a substituent; and q is 0 to 4;

$Z^a$ represents the atoms necessary to complete an unsubstituted or substituted 5- to 10-membered heterocyclic ring system which may contain one or more other heteroatoms selected from nitrogen, oxygen and sulfur;

providing that each $R^c$ is attached to a carbon atom of the ring; and

X is selected from hydrogen or halogen or a group which is separable by the reaction of coupler with an oxidized colour developing agent; and wherein the stabilizer of formula (III) has the formula (III)

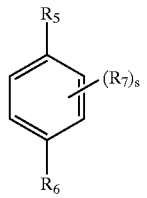

wherein $R_5$ is an electron-donating group;

$R_6$ is a substituent;

each $R_7$ is an independently selected substituent; or one of $R_5$ and $R_6$ may join with $R_7$ to form an unsubstituted or substituted 5- to 10-membered ring system which may contain one or more heteroatoms selected from nitrogen, oxygen and sulfur; and s is 0 to 4;

provided that (a) when one of $R_5$ and $R_6$ is a hydroxy group then the other may not be an arylsulfonamido or arylsulfamoyl substituent, and (b) at least one of $R_5$, $R_6$ and $R_7$ contains a ballast group comprising at least 8 carbon atoms.

33. A process of forming an image in a photographic element after the element has been imagewise exposed to light, comprising contacting the element with a colour developing agent, wherein the element comprising at least one light-sensitive silver halide emulsion layer having associated therewith in the same dispersion a de-aggregating compound of formula (I), at least one heterocyclic cyan dye-forming coupler of formula (II) and a stabilizer of formula (III):

wherein the de-aggregating compound has the formula (I)

(I)

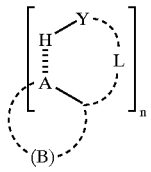

wherein

A is a hydrogen-bond-accepting hetero-atom or -group;

Y is a hydrogen-bond-donating hetero-atom or -group;

L is a linking group that is partially or wholly conjugated with A and linked to A by a carbon atom;

n is 1, 2 or 3 hydrogen-bond-containing moieties; and (B) comprises the remaining atoms for completion of an unsubstituted or substituted heterocyclic ring or ring system containing the hydrogen bond-accepting hetero-atom or -group, which may contain one or more other heteroatoms selected from nitrogen, oxygen and sulfur; and wherein the heterocyclic cyan dye-forming coupler has the formula (II):

(II)

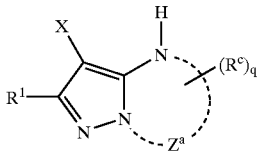

wherein $R^1$ is hydrogen or a substituent;

$R^c$ is a substituent; and q is 0 to 4;

$Z^a$ represents the atoms necessary to complete an unsubstituted or substituted 5- to 10-membered heterocyclic ring system which may contain one or more other heteroatoms selected from nitrogen, oxygen and sulfur;

providing that each $R^c$ is attached to a carbon atom of the ring; and

X is selected from hydrogen or halogen or a group which is separable by the reaction of coupler with an oxidized colour developing agent; and wherein the stabilizer of formula (III) has the formula (III)

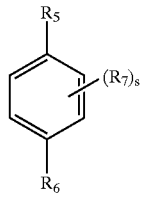

wherein $R_5$ is an electron-donating group;

$R_6$ is a substituent;

each $R_7$ is an independently selected substituent; or one of $R_5$ and $R_6$ may join with $R_7$ to form an unsubstituted or substituted 5- to 10-membered ring system which may contain one or more heteroatoms selected from nitrogen, oxygen and sulfur; and s is 0 to 4;

provided that (a) when one of $R_5$ and $R_6$ is a hydroxy group then the other may not be an arylsulfonamido or arylsulfamoyl substituent, and (b) at least one of $R_5$, $R_6$ and $R_7$ contains a ballast group comprising at least 8 carbon atoms.

* * * * *